US005647582A

United States Patent [19]

Shiba

[11] Patent Number: 5,647,582

[45] Date of Patent: Jul. 15, 1997

[54] ROTARY PRESS WITH A PLURALITY OF ROLLS OF PAPER AND PRINTING METHOD USING SUCH A ROTARY PRESS

[75] Inventor: Noriyuki Shiba, Tokyo, Japan

[73] Assignee: Kabushiki Kaisha Tokyo Kikai Seisakusho, Japan

[21] Appl. No.: 541,530

[22] Filed: Oct. 10, 1995

[30] Foreign Application Priority Data

Aug. 11, 1995 [JP] Japan ..... 7-205907

[51] Int. Cl.[6] ..... B41F 13/58

[52] U.S. Cl. ..... 270/8; 270/5.02; 270/21.1

[58] Field of Search ..... 270/4, 5.01, 5.02, 270/5.03, 6, 8, 9, 10, 11, 20.1, 21.1

[56] References Cited

U.S. PATENT DOCUMENTS

| | | | |
|---|---|---|---|
| 1,074,699 | 10/1913 | Doll | 270/5.01 |
| 1,348,553 | 8/1920 | Dowell | 270/5.01 |
| 1,437,707 | 12/1922 | Bechman | 270/8 |
| 1,717,381 | 6/1929 | Halliwell | 270/5.01 |
| 1,781,017 | 11/1930 | Knox | 270/5.01 |
| 2,291,627 | 8/1942 | Huck | 270/5.01 |
| 2,673,315 | 3/1954 | Seeger | 270/5.01 X |

FOREIGN PATENT DOCUMENTS

| | | |
|---|---|---|
| 50-150401 | 5/1949 | Japan . |
| 51-146902 | 12/1976 | Japan . |
| 56-6951 | 2/1981 | Japan . |
| 5-254084 | 5/1993 | Japan . |
| 5-193092 | 8/1993 | Japan . |
| 6-47905 | 2/1994 | Japan . |

OTHER PUBLICATIONS

Newspaper Printing, Chapter Printing —Revised Edition, Japan Newspaper Association, Oct. 31, 1980, FIG. 1 on p. 348, FIG. 2 on p. 349.

"Modern Newspaper Presses and High–Quality Printing", IFRA Newspaper Techniques, Jun., 1995, pp. 52 and 53.

*Primary Examiner*—Hoang Nguyen
*Attorney, Agent, or Firm*—Ronald P. Kananen

[57] ABSTRACT

In a rotary press comprised of one or more constructional units each including: a plurality of paper feed stations, a plurality of printing stations, a single folding station having a cutting function. An improvement in the or each constructional unit further comprises a first drive source for the folding station and a second drive source separately provided from the first drive source for operating the printing stations and the paper feed stations. In addition, a control apparatus may be provided for controlling both the first drive source and the second drive source so that the folding station and the printing stations may, in the constructional unit, be operated in a matched state. A control apparatus may also be provided capable of selectively combining the printing stations and a respective one of the folding stations together independently of the constructional units for controlling both the first drive source and the second drive source so that those folding station and printing stations which are selectively combined together may be operated in a matched state. A guide mechanism being capable of selectively guiding the continuous sheets of paper onto the folding stations in one and another of the constructional units. An improved printing method using such a rotary press is also claimed.

36 Claims, 20 Drawing Sheets

ROTARY PRESS WITH A PLURALITY OF ROLLS OF PAPER AND PRINTING METHOD USING SUCH A ROTARY PRESS

FIELD OF THE INVENTION

The present invention relates to an improvement in the rotary press, for example, for printing a newspaper, which is constituted with one or more constructional units, each of which comprises: a plurality of paper feed stations which are capable of loading a plurality of rolls of paper respectively thereon for continuously feeding continuous sheets of paper respectively drawn out of the rolls of paper; a plurality of printing stations for printing on the continuous sheets of paper continuously drawn out of the rolls of paper in the paper feed stations; and a folding station for cutting the printed continuous sheets of paper and folding the cut sheets of paper as prints, the latter being discharged onto an instrument in a downstream stage. The invention also relates to an improved printing method using such a rotary press.

BACKGROUND OF THE INVENTION

The newspaper has been produced by a rotary press which is provided with a plurality of printing stations which are capable of printing on continuous sheets of paper, generally called "W-width rolled sheets of paper" (e.g. a volume A defined in Japan at the section "the rolled sheets for a newspaper" according to JIS P3001), with 4 pages on one side and 8 pages on both sides. The rotary press is further constituted by a plurality of paper feed stations for continuously feeding such continuous sheets of paper to the above mentioned printing stations and a folding station for overlapping, cutting and folding the continuous sheets of paper that have been printed. Typically in a series of downstream stages, the stacking, packaging and banding of the folded printed sheets of paper in a predetermined circulations are continuously carried out with a plurality of instrumental units adapted respectively therefor.

FIGS. 19 and 20 show a certain example of the rotary press which has been manufactured by the assignee of the present patent application, which has three constructional units which are serially aligned in a direction that is perpendicular to the axis of a printing cylinder. Each of the constructional units is capable of producing a newspaper of 32 pages and is constituted by one printing station 112 that is composed of four printing means stacked one upon another so as to be capable of simultaneously printing on both sides of a continuous sheet of paper W and is capable of printing on both sides of a continuous sheet of paper W in four colors, three printing stations 112' that are each composed of two printing means stacked one upon the other so as to be capable of simultaneously printing on both sides of a continuous sheet of paper W and is capable of printing on both sides of a continuous sheet of paper W in two colors, four feed stations 101 capable of loading four rolls of paper WR respectively therein for feeding the continuous sheets of paper W to these four printing stations 112 and 112', respectively, and one folding station 104 for overlapping, cutting and folding the continuous sheets of paper that have been printed.

In this rotary press, these individual printing stations and the folding stations are installed on a common machinery table 103 and are integrally formed thereon. Also, instruments in subsequent stages are provided on a separate floor, and there is provided a long path conveyer unit 114 (of which only a starting end in each constructional unit is shown) is provided in each individual constructional unit to communicate both the table and the floor with each other.

In comparison with the above, there has been known a rotary press in which a folding station is displaceably mounted, as disclosed, for example, in Japanese Examined Patent Publication No. Sho 56-6,951 and Japanese Unexamined Patent Publication No. Hei 05-254,084 in which the folding station is integrally coupled with a series of printing stations by being mounted on a common machinery table during a printing operation.

On the other hand, there has also been known a rotary press as disclosed in Japanese Unexamined Patent Publication No. Sho 51-146,902, No. Hei 05-193,092 and Hei 06-47,905 in which its folding station is made displaceable independently of the other stations therein.

Further, in Japanese Unexamined Patent Publication No. Sho 51-146,902 there is disclosed a rotary press in which its folding station is made capable of being independently driven. According to the drive mechanism disclosed in this publication, it is asserted that in advance of a printing operation any slackening of a continuous sheet of paper that may be caused ahead thereof can be eliminated, any difference in position between a printing image to be applied to the continuous sheet of paper and its cutting location that may be generated when a printing operation is commenced can be avoided, and any adverse influence upon the continuous sheets of paper that may be experienced during a printing operation due to a change in the paper quality, a change in the total number of continuous sheets of paper, and an acceleration and deceleration of the printing speed can be corrected.

Also, in Japanese Unexamined Patent Publication No. Hei 05-193,092 and No. Hei 06-47,905 there is disclosed a rotary press which is provided with a drive means designed to drive each individual printing station and the folding station separately, and it is asserted that the practice of the drive mechanism disclosed enables an estimated accuracy to be enhanced, a mechanical construction of the unit to be simplified, and a mechanical extension to be facilitated.

Notwithstanding to the above, with respect to the rotary press disclosed as having an independently displaceable folding station, there is no description or suggestion at all regarding a mechanism which should have to be provided so as to separate a printing station and the folding station from each other. On the contrary, Japanese Unexamined Patent Publication No. Hei 05-193,092 shows in its accompanying drawings, FIGS. 1 through 6 a mechanism in which each individual printing station and the folding station are arranged as aligned in a row while these aligned stations are integrally coupled with each other by means of a horizontal axis or a horizontally synchronized axis.

In sum, in the conventional types of the rotary press as mentioned above which have employed a mechanism that is designed to operate in a state in which the folding station is integrally coupled with a series of printing stations, there have been encountered problems to be resolved that will be discussed below.

(A) While a continuous sheet of paper is cut and folded by the above-mentioned folding station during an operation of the rotary press, (a) Vibrations are generated in the folding and the cutting cylinders when the continuous sheets of paper are cut, and the vibrations are propagated to the printing station adjacent thereto via a common machinery table to cause the printing stations to be also vibrated, possibly deteriorating the quality of the printing image even slightly but never negligibly; and (b) Also, an extremely large sound is emitted when the continuous sheets of paper are cut and folded, which increases its magnitude as the operation is made faster, hence the folding station is an extraordinary noise source on the floor for a printing operation job; thus, a need has acutely arisen to reduce such offensive noise emitted from the folding station in order to improve the job environment on the printing operational floor.

(B) On the conventional rotary press, the printing stations are installed as aligned so as to form a row thereof that is oriented perpendicular to the axes of the printing cylinders while the folding station is installed in a row common to the above mentioned row so that the axis of the folding cylinder may be oriented perpendicular to the axes of the plate cylinders in the printing stations, thereby causing the prints to be discharged in a direction perpendicular to the axis of the folding cylinder; accordingly, the folding station needs to be provided with a particular print discharge mechanism which laterally projects from the row in which the printing stations and the folding station are arranged as aligned in series, as shown in FIG. 1 on page 348 and FIG. 2 on page 349 of a publication "Newspaper Printing, Chapter Printing—Revised Edition" published Oct. 31, 1980 by the Japan Newspaper Association; it follows therefore that an end of such a print discharge mechanism must be operationaly coupled to a conveyer mechanism designed to discharge the prints towards an instrument in a downward stage.

(c) And, therefore, an operator who is required to displace along a row in which the above mentioned printing stations and the folding station are installed as aligned and then to perform an operation at each individual station will be compelled to make a detour around the said print discharge mechanism which projects from the folding station, thus constituting a big obstacle when an emergency movement is required or when a comparatively large hardware, e.g. an exchange roller needs to be conveyed;

(d) Also, in relation to retaining a path of detouring the above mentioned print discharge mechanism, it is necessary to secure, on the side in which the said print discharge mechanism is projected, a broad space which is equal to the amount of projection of the above mentioned print discharge mechanism plus a width of the above mentioned detouring path, thus making it to become in vain; and (e) Further, the prints that have been individually cut for discharge out of the above mentioned print discharge mechanism may have given rise to an inconvenience such as an aberration, clogging or drop in being transported by a conveyance mechanism in a transport passage which has a number of curves and is relatively long covering a variety of instruments in the downstream stages.

(C) Also, the rotary press is comprised of a constructional unit which comprises a plurality of paper feed stations, a plurality of printing stations which are at least equal in number to the paper feed stations and a single folding station; normally, as shown in FIGS. 19 and 20, with a plurality of such constructional units being serially arranged, their entire length becomes extremely long, say, 57 m or a bit more in the rotary press as shown in FIGS. 19 and 20. In this connection, it may also be noted that in a monthly magazine "ifra newspaper techniques English Edition", June, 1995, pages 52 and 53, published by INCA-FIEJ Research Association, there is shown a rotary press which extends in its entire length over 96 m.

(f) Therefore, a building which is capable of receiving the rotary press therein has heretofore been proportionally lengthened to cause the bad building balance and this has also resulted in a comparatively high building cost in order to be acceptable in its strength;

(g) Also, it has hitherto been difficult to secure a land which can be commensurate with the foregoing building requirement;

(h) Furthermore, it has hitherto been difficult to thoroughly inspect, and conduct an operation of, such a rotary press over from one end to the other by a small member of operators;

(i) On the other hand, in printing a newspaper, for example, if it is required to increase the number of pages of one set of a newspaper, e.g. from 35 pages to 40 pages, this requirement can often be met by increasing the number of the printing and paper feed stations. However, in case a plurality of constructional units are serially connected one to another as mentioned above, an increase in the number of those stations would result in an aberration in the arrangement of the printing stations relative to the folding station for each individual constructional unit. As a result, for each individual constructional unit, there unavoidably ensue a variation in the paper passage route and a difference in the printing cylinder loading positions; the consequence of these has hitherto been that a routine job required for a printing operation is susceptible of suffering a confusion and error and, the conventional rotary press that employs a plurality of rolled sheets of paper has been hard to use.

In connection with the above, it may be noted that there has hitherto been known a technique as disclosed in Japanese Utility Model Publication No. Sho 50-150,401 intended to resolve the problems (c) and (d) as mentioned above. The disclosure of this publication is characterized in that a paper feed station, a printing station, a dryer and cooler station, a folding machine equipped with a paper sheet discharge unit and a counter stacker which represents an instrument in a downstream stage, are serially arranged in a direction in which a printing sheet of paper is advanced. If such a construction is applied to a rotary press as shown in FIGS. 19 and 20, it is readily apparent that the rotary press becomes much more augmented in its overall length. What is more, not only can the above mentioned problems (f), (g), (h) and (i) not be resolved at all, but they will further be worsened there. It may also be said that the gist of this publication is that it is intended to achieve a particular effect of the proposed utility model by restricting the layout of the elements that constitute the rotary press.

SUMMARY OF THE INVENTION

With the foregoing in mind, it is a primary object of the present invention to provide a rotary press with a plurality rolls of paper and a printing method using such a rotary press, which seek to resolve the problem (a) mentioned above.

It is another object of the present invention to provide a rotary press and a printing method of the type described, which seek to resolve the problem (b) mentioned above.

It is still another object of the present invention to provide a rotary press and a printing method of the type described, which seek to resolve the problems (c) and (d) mentioned above.

It is yet another object of the present invention to provide a rotary press and a printing method of the type described, which seek to resolve the problem (e) mentioned above.

It is a further object of the present invention to provide a rotary press and a printing method of the type described, which seek to resolve the problems (f), (g) and (h) mentioned above.

It is a still further object of the present invention to provide a rotary press and a printing method of the type described, which seek to resolve the problem (i) mentioned above.

These and other objects are attained, in accordance with the present invention, in a first structural aspect thereof, by providing a rotary press using a plurality of rolls of paper, in which there are provided a plurality of paper feed stations, a plurality of printing stations that are at least equal in number to the said paper feed stations and a single folding station, and in which continuous sheets of paper respectively drawn out of the said rolls of paper respectively loaded onto the said paper feed stations are guided, as they are overlapped, onto the said folding station via a said printing stations respectively corresponding to the said paper feed stations and are cut in the said folding station, and the cut sheets of paper are folded up as prints, the latter being discharged towards an instrument in a downstream stage, which rotary press comprises: the said folding station that is disposed separately from the said printing stations as well as from the said paper feed stations; first drive source means for operating the said folding station; second drive source means provided separately from the said first drive source means for operating the said printing stations and the said paper feed stations; and a control means for controlling both the said first drive source means and the said second drive source means so that the said folding station and the said printing stations may, in a constructional unit of the rotary press, be operated in a matched state.

The present invention also provides, in a second structural aspect thereof, a rotary press using a plurality of rolls of paper in which there are provided a plurality of constructional units, each of which includes a plurality of paper feed stations, a plurality of printing stations that are at least equal in number to the said paper feed stations and a single folding station, and in which continuous sheets of paper respectively drawn out of the said rolls of paper respectively loaded onto the said paper feed stations are guided, as they are overlapped, into the said folding station via said printing stations respectively corresponding to the said paper feed stations and are cut in the said folding station, and the cut sheets of paper are folded up as prints, the latter being discharged towards an instrument in a downstream stage, which rotary press comprises: the said folding station that is disposed separately from the said printing stations as well as from the said paper feed stations for each of the said constructional units; first drive source means for operating said folding stations; second drive source means for operating the said printing stations and the said paper feed stations; a control means capable of selectively combining the said printing stations and a said folding station together independently of the said constructional units for controlling both the said first drive source means and the said second drive source means so that those said folding station and said printing stations which are selectively combined together may be operated in a matched state; and a guide mechanism disposed downstream of the said printing stations and upstream of the said folding stations so as to guide the said continuous sheets of paper passed through the said printing stations, the said mechanism being capable of selectively guiding the said continuous sheets of paper onto the said folding stations in one and another of said constructional units.

The present invention also provides, in a third structural aspect thereof, a rotary press using a plurality of rolls of paper, in which there are provided a plurality of constructional units, each of which includes a plurality of paper feed stations, a plurality of printing stations that are at least equal in number to the said paper feed stations and a single folding station, and in which continuous sheets of paper respectively drawn out of the said rolls of paper respectively loaded onto the said paper feed stations are guided, as they are overlapped, onto the said folding station via the said printing stations respectively corresponding to the said paper feed stations and are cut in the said folding station, and the cut sheets of paper are folded up as prints, the latter being discharged towards an instrument in a downstream stage, which rotary press comprises: the said folding station that is disposed separately from the said printing stations as well as from the said paper feed stations for each of the said constructional units, the said constructional units being arranged in divided parallel rows; first drive source means for operating said folding stations; second drive source means provided separately from the said first drive source means for operating the said printing stations and the said paper feed stations; a control means capable of selectively combining the said printing stations and a said folding station together independently of the said constructional units for controlling both the said first drive source means and the said second drive source means so that those said folding station and said printing station which are selectively combined together may be operated in a matched state; and a guide mechanism disposed downstream of the said printing stations and upstream of the said folding stations so as to selectively guide the said continuous sheets of paper passed through the said printing stations, the said mechanism being capable of selectively guiding the said continuous sheets of paper onto the said folding stations in one and another of said constructional units.

It should be noted that each of the foregoing structural aspects of the present invention effectively resolves the conventional problem (a) mentioned above. It should also be noted that the third structural aspect of the present invention effectively resolves the conventional problems (f), (g) and (h) mentioned above.

Further, according to a first concomitant structural feature of the present invention, for the said one or each structural unit, the said folding station is disposed at a location that is out of a row in which the said printing stations are arranged in series as well as from a region which represents an extension thereof.

It should be noted that the preceding structural feature of the present invention when combined with any of the foregoing structural aspects thereof effectively resolves the conventional problems (c), (d) and (i) mentioned above.

Yet, according to a second concomitant structural feature of the present invention, for the said one or each structural unit, the said folding station is disposed adjacent to the said instrument in the said downstream station.

It should be noted that the preceding structural feature of the present invention when associated with any of the foregoing structural aspects thereof, further in or without combination with the first concomitant structural feature of the invention effectively resolves the conventional problem (e) mentioned above.

Also, according to a third concomitant structural feature of the present invention, a rotary press hereof further comprises a structure for surrounding the said folding station, thereby restraining a noise that is emitted therefrom.

Alternatively, a rotary press hereof may comprise a structure for surrounding the said folding station as well as the said instrument in the said downstream station, thereby restraining a noise that is emitted from either of them.

It should be noted that the preceding alternative two structural feature of the present invention when associated with any of the foregoing structural aspects hereof, further in or without combination with the first and/or second concomitant structural feature(s) of the invention effectively resolves the conventional problem (b) mentioned above.

Furthermore, in accordance with a first procedural aspect of the present invention, there is provided a printing method using a rotary press with a plurality of rolls of paper, in which there are provided a plurality of paper feed stations, a plurality of printing stations that are at least equal in number to the said paper feed stations and a single folding station, and in which continuous sheets of paper respectively drawn out of said rolls of paper respectively loaded onto the said paper feed stations are guided, as they are overlapped, onto the said folding station via the said printing stations respectively corresponding to the said paper feed stations and are cut in the said folding station, and the cut sheets of paper are folded up as prints, the latter being discharged towards an instrument in a downstream stage, which printing method comprises the steps of: disposing the said folding station separately from both the said printing stations and the said paper feed stations; operating the said folding station with first drive source means; operating the said printing stations and the said paper feed stations with second drive means provided separately from the said first drive source means; and controlling the said first drive source means and the said second drive source means so that the said folding station and the said printing stations in a constructional unit of the rotary press may be operated in a matched state.

In accordance with a second procedural aspect of the present invention, there is also provided a printing method using a rotary press with a plurality of paper rolls, in which there are provided a plurality of constructional units each of which comprises a plurality of paper feed stations, a plurality of printing stations that are at least equal in number to the said paper feed stations and a single folding station, and in which continuous sheets of paper respectively drawn out of the said rolls of paper respectively loaded onto the said paper feed stations are guided, as they are overlapped, onto the said folding station via the said printing stations respectively corresponding to the said paper feed stations and are cut in the said folding station, and the cut sheets of paper are folded up as prints, the latter being discharged towards an instrument in a downstream stage, which printing method comprises the steps of: disposing the said folding station separately from both the said printing stations and the said paper feed stations for each of the said constructional units; operating the said folding stations with first drive source means; operating the said printing stations and the said paper feed stations with second drive source means provided separately from the said first drive source means; selectively combining the said printing stations and a said folding station together independently of the said constructional units to control both the said first drive source means and the said second drive source means so that those said folding station and said printing stations which are selectively combined together may be operated in a matched state; and providing a guide mechanism downstream of the said printing stations and upstream of the said folding stations to guide the said continuous sheets of paper passed through the said printing stations, the said mechanism being capable of selectively guiding the said continuous sheets of paper onto the said folding stations in one and another of the said constructional units.

In accordance with a third procedural aspect of the present invention, there is also provided a printing method using a rotary press with a plurality of paper rolls, in which there are provided a plurality of constructional units, each of which includes a plurality of paper feed stations, a plurality of printing stations that are at least equal in number to the said paper feed stations and a single folding station, and in which continuous sheets of paper respectively drawn out of the said rolled sheet respectively loaded onto the said paper feed stations are guided, as they are overlapped, into the said folding station via the said printing station respectively corresponding to the said paper feed stations and are cut in the said folding stations, and the cut sheets are folded up as prints, the latter being discharged towards an instrument in a downstream station, which printing method comprises the steps of: disposing said folding station separately from both said printing stations and said paper feed stations for each of said constructional units; arranging said constructional units in divided parallel rows, respectively; operating said folding stations with first drive source means; operating said printing stations and said paper feed stations with second drive source means provided separately from said first drive source means; selectively combining said printing stations and a said folding station together independently of said constructional units to control both said first drive source means and said second drive source means so that those said folding station and said printing stations which are selectively combined together may be operated in a matched state; providing a guide mechanism disposed downstream of said printing stations and upstream of said folding stations so as to guide said continuous sheets of paper passed through said printing stations; and selectively guiding, with said mechanism, said continuous sheets of paper onto said folding stations in one and another of said constructional units.

It should be noted that each of the foregoing procedural aspects of the present invention effectively resolves the conventional problem (a) mentioned above. It should also be noted that the third procedural aspect of the present invention effectively resolves the conventional problems (f), (g) and (h) mentioned above.

Further, according to a first concomitant procedural feature of the present invention, for the said one or each constructional unit, the said folding station is disposed at a location that is out of a row in which the said printing stations are arranged is series as well as from a region which represents an extension thereof.

It should be noted that the preceding procedural feature of the present invention when combined with any of the foregoing procedural aspects thereof effectively resolves the conventional problems (c), (d) and (i) mentioned above.

Yet, according to a second concomitant procedural feature of the present invention, for the said one or each constructional unit, the said folding station is disposed adjacent to the said instrument in the said downstream station.

It should be noted that the preceding procedural feature of the present invention when associated with any of the foregoing procedural aspects thereof, further in or without combination with the first concomitant procedural feature of the invention effectively resolves the conventional problem (e) mentioned above.

Also, according to a third concomitant procedural feature of the present invention, a printing method thereof further comprises the step of surrounding, with an enclosure structure, the said folding station to restrain a noise that is emitted therefrom.

Alternatively, a printing method hereof may further comprise the step of surrounding, with an enclosure structure, both the said folding station and the said instrument in the said downstream station to restrain a noise that is emitted from either of them.

It should be noted that the preceding alternative two procedural features of the present invention when associated with any of the foregoing procedural aspects hereof, further in or without combination with the first and/or second concomitant procedural feature(s) of the invention effectively resolves the conventional problem (b) mentioned above.

BRIEF EXPLANATION OF THE DRAWINGS

These and other objects, aspects, features and advantages of the present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Figure 1:
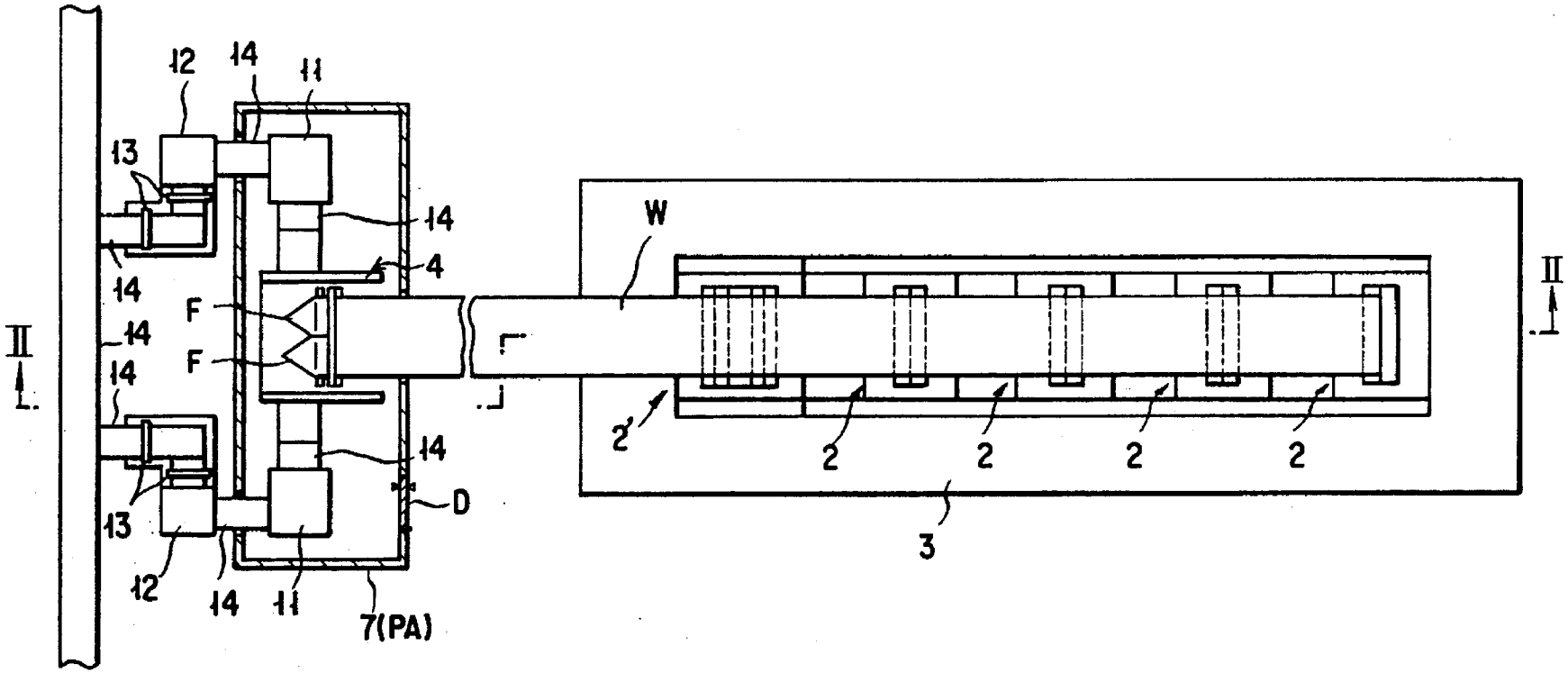
FIG. 1 is a top plan view, partly cut away, diagrammatically showing a rotary press in a certain illustrative form of embodiment according to the present invention.
Figure 2:
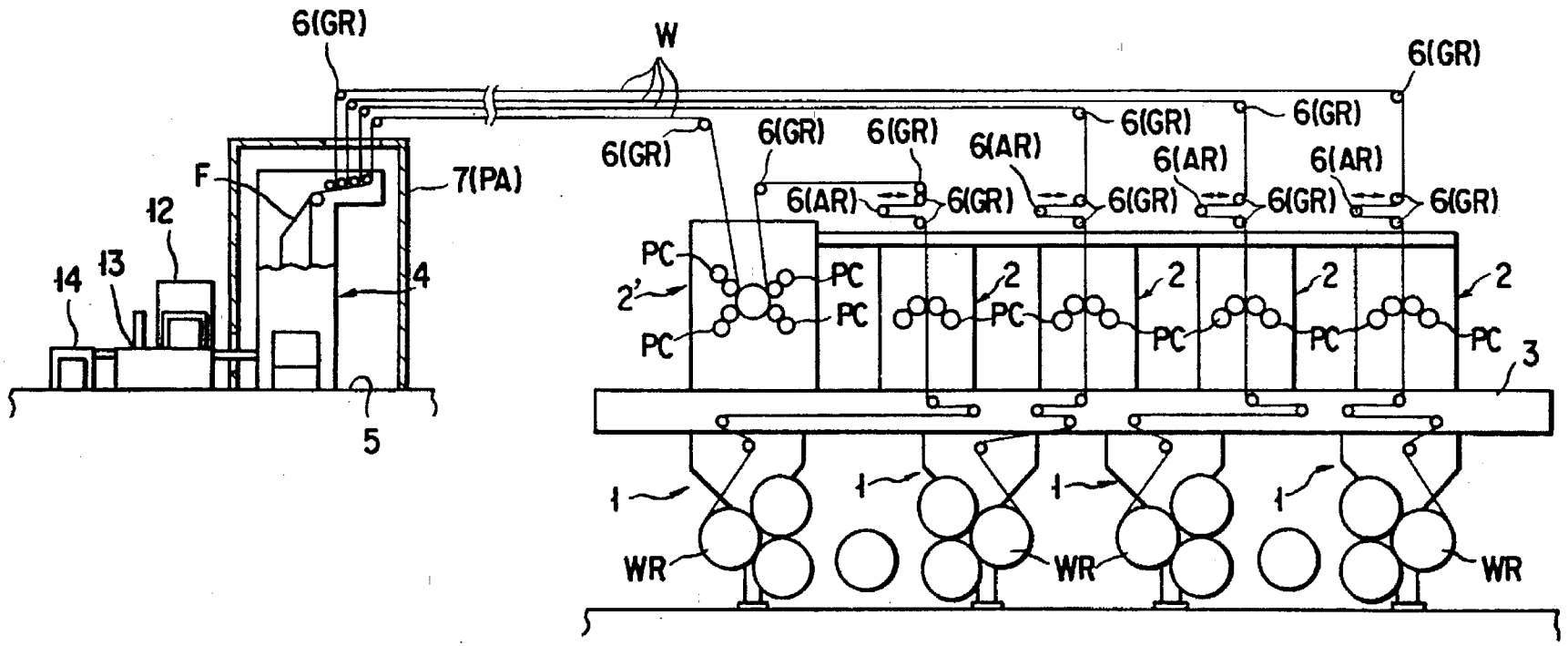
FIG. 2 is an elevational view in section, as taken along the line II—II and as viewed in the direction of the arrows in FIG. 1.

Referring now to FIGS. 1 and 2, a typical form of embodiment of the present invention will first be set out.

In this form of embodiment, it can be seen that in a rotary press, four paper feed stations 1 are arranged in an alignment in the direction that is perpendicular to the respective parallel axes of rolls of paper WR which are loaded respectively thereon and each of which allows a continuous sheet of paper W to be drawn out of it. It will be seen that above these paper feed stations there is supported a machinery table 3 on which there are mounted four printing stations 2 each of which has a single printing means that is capable of simultaneously printing on both sides of each individual continuous sheet of paper W. In addition, there is mounted a single printing station 2' having four printing means which are capable of printing on one side of the continuous sheet of paper W in four colors by successively printing thereon at four locations in this station. The four printing stations 2 and the single printing station 2' are aligned in a direction which is parallel to the direction in which the four paper feed stations are aligned, whereas the respective parallel axes of printing cylinders PC which are provided in the printing stations 2 and 2' are oriented parallel to the respective parallel axes of the paper rolls WR which are loaded in the paper feed stations 1, respectively.

On the other hand, a folding station 4 which, together with the paper feed stations 1 and the printing stations 2 and 2', constitutes the rotary press is mounted on a machinery table 5 which is disposed separately from the machinery table 3 on which the printing stations 2 and 2' are mounted.

The level of the machinery table 5 on which the folding station 4 is mounted needs not to be in coincidence with the level of the machinery table 3. In the folding station 4, a folding cylinder thereof (not shown) may be mounted so as to have its axis oriented in a suitable direction. With the folding station 4 lying in an extension of a series of the printing stations 2 and 2', or upwards or downwards thereof, except where the folding cylinder (not shown) is mounted so as to have its axis oriented perpendicular to the axes of the printing cylinders PC of the printing stations 2 and 2', a guide mechanism 6 constituted by a plurality of guide rollers GR for guiding the continuous sheets of paper W from the printing stations 2 and 2' into the folding station 4 is provided with at least one angle bar AB (e. g. see FIG. 4).

Figure 17:
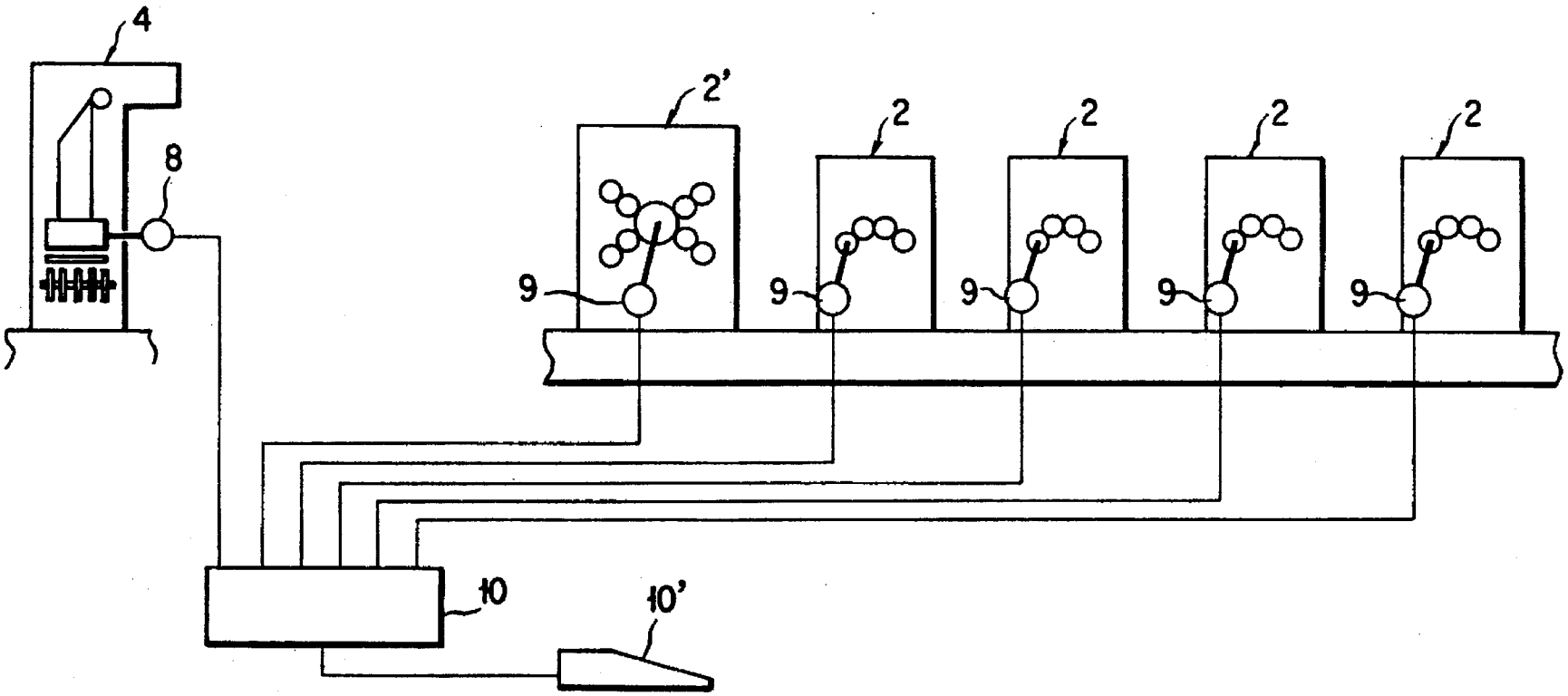
FIG. 17 is a schematic view diagrammatically illustrating a state of connections in which a drive source for operating a folding station and a drive source for operating a printing station are coupled together according to the present invention.
Figure 18:
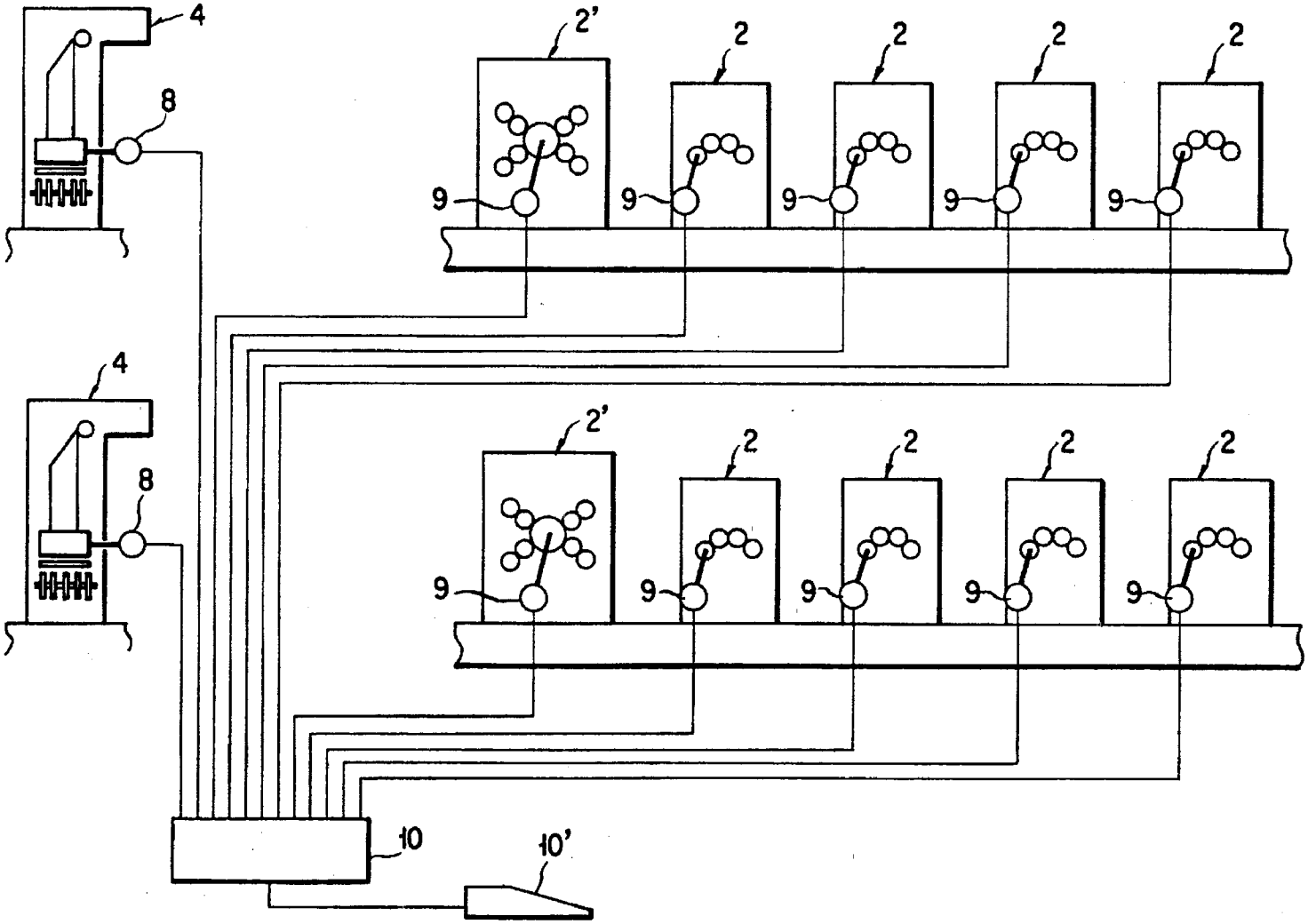
FIG. 18 is a schematic view diagrammatically illustrating a state of connections in which a drive source for operating a respective folding station in a plurality of constructional units of a rotary press and a drive source for operating a printing stations and a control means incorporated therein are coupled together.
Figure 19:
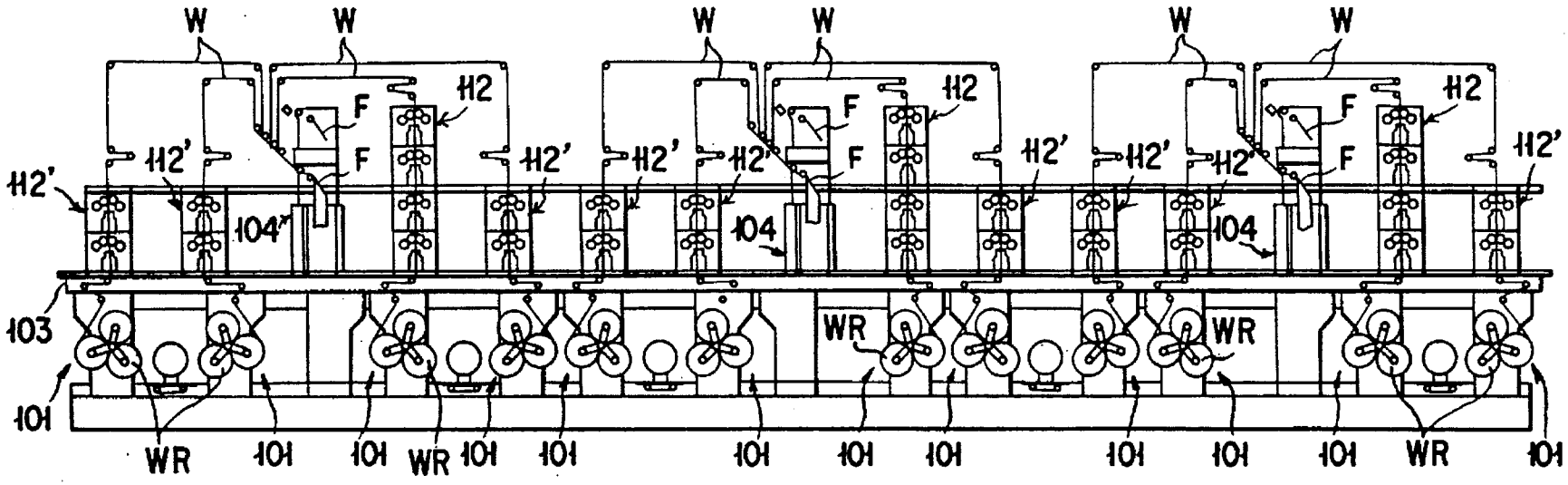
FIG. 19 is a frontal elevational view diagrammatically illustrating a form of arranging a paper feed station, a printing station and a folding station in the conventional rotary press.
Figure 20:
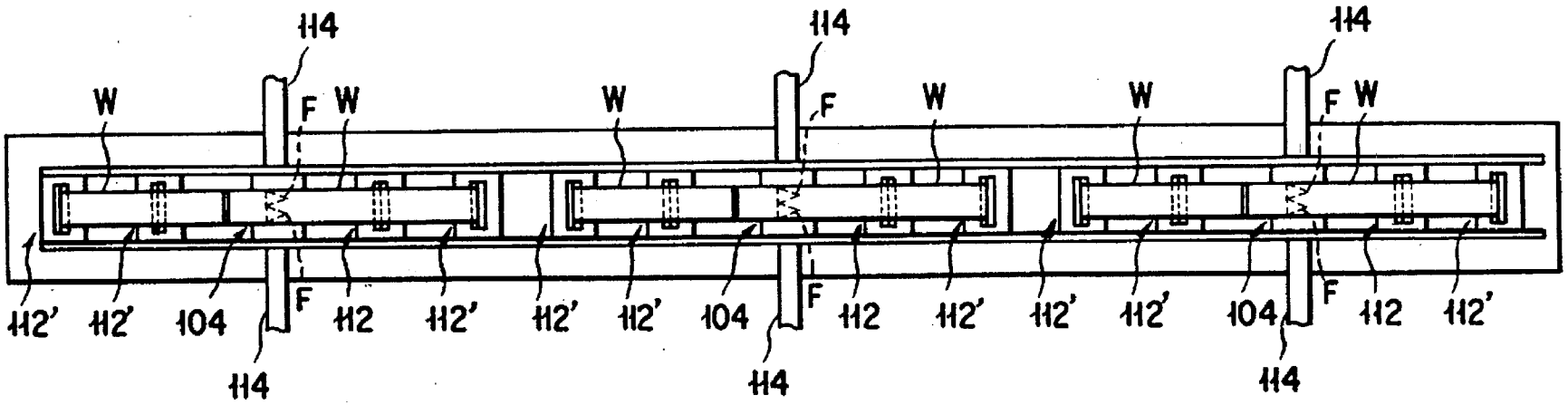
FIG. 20 is a top plan view diagrammatically illustrating a form of arranging a paper feed station, a printing station and a folding station in the conventional rotary press.

Further, as shown in FIG. 17, the folding station 4 is provided with a first drive source means 8 by which it is operated and which is provided independently of a second drive source means, i. e. here a drive source 9 for operating the printing stations 2 and 2'. And, in order to have the folding station 4 and the printing stations 2 and 2' operated in a matched state, the above mentioned drive source 8 for operating the folding station 4 and the above mentioned other drive source 9 are coupled together by a control means 10 and are designed to be controlled thereby.

Also, the above mentioned second drive source 9 may be divided into five individually independent drive sources for operating the five printing stations 2 and 2', respectively. The mutually independent drive sources 9 are then coupled with respective control means 10 as mentioned above so that the individual printing stations 2 and 2' and the folding station 4 may be operated in a matched state. In connection with the above, an input means 10' is also provided for the entry of command signals into the control means 10.

In the rotary press in which the second drive source 9 is constituted by the mutually independent drive sources, it is possible to selectively specify, by way of the control means 10, the printing stations 2 and 2' which are to be operated together with the folding station 4. Depending on the number of pages of prints and the presence or absence of a multi-colored image in the prints, the rotary press is operated with unnecessary one or ones of the printing stations 2 and 2' being deactivated. An enhanced economical effect is thereby achieved. Also, it is possible to eliminate adjustment rollers AR as will be set forth hereinafter.

In the vicinity of the folding station 4 mounted on the above mentioned machinery table 5, there is provided instruments in subsequent stages for processing the prints (not shown) that are discharged from the folding station 4. Such instruments of the subsequent stages include, for example, a counting accumulation unit 11, a packaging unit 12, a banding unit 13 and, in addition to each of these, a conveyance unit 14 linked with the upstream and downstream stages.

Further, the folding station 4 is enclosed in a surrounding structure 7 made up of suitable members such as, for example, a panel assembly PA for sound proofing. The enclosure structure 7 is provided with a suitable window (not shown) such that the state of an interior operation of the folding station 4 can be viewed from the outside, with an entrance for the continuous sheets of paper W and an exit for the prints (not shown) and also with a door D for an operator to enter into and exit from the enclosure structure 7. In this connection, it may be noted that if the panel assembly PA is constituted by a transparent material, the above mentioned window needs not to be provided.

In FIGS. 1 and 2, it is seen that each continuous sheet of paper W is guided from each paper feed station 1 via such a printing station 2, 2' as corresponding to that paper feed station 1 up to the folding station 4 while retaining its entire width. Directly upstream of a pair of formers (i.e. triangular plates) F in the folding station 4, it is shown that the continuous sheets of paper W are then lapped one over another and divided into two. Thus, a guide mechanism 6 is shown which is designed to guide these two into the two adjacent formers (i. e. triangular plates) F, respectively. Unlike this construction, however, it is also possible to divide the continuous sheets of paper W into two directly downstream of the printing stations 2 and 2'. Then, by means of an overlapping mechanism (not shown) provided with at least a pair of angle bars, the one and the other of the divided continuous sheets of paper W can be guided, as they are stacked one upon the other, into the folding station 4. Thus, an alternative guide mechanism (not shown) may be utilized having a guiding function whereby the one and the other of the divided continuous sheets of paper W are then overlapped directly upstreams of one of the two adjacent formers (i. e. triangular plates) F and guided only into the one former (i.e. triangle plate) F mentioned.

In regard to the adjustment rollers AR which constitute a portion of the guide mechanism 6, it may be noted that by displacing those rollers AR in the directions of the arrows shown, the guiding lengths for the respective continuous sheets of paper W from the respective printing stations 2 and 2' up to the folding station 4 can be altered. This will enable a cutting position to be suitably matched relative to a printing image.

The operation of the rotary press constructed as mentioned above is carried out as set forth below.

The continuous sheets of paper W which are respectively drawn out of the rolls of paper WR that are loaded on the corresponding paper feed stations 1 will be guided via the corresponding printing stations 2 and 2' onto the folding station 4. The rotary press will then be activated under control by the control means 10. Then, the printing stations 2 and 2' and the folding station 4 will be activated simultaneously and operated in a matched state. If the drive source 9 are divided for the five printing stations 2 and 2', that is, the second drive sources 9 are mutually independent, only those of the printing stations 2 and 2' which are specified for selection to operate will be activated together with the folding station 4. The act of specifying for selection is performed by the input means 10' provided in association with the control means 10.

When the rotary press is operated, the printing stations 2 and 2' will perform the printing on the continuous sheets of paper W and the folding station 4 will cut the printed continuous sheets of paper and fold the cut sheets of paper for discharge as prints. The prints for discharge, by being conveyed to pass through the counting accumulation units 11, the packaging units 12 and the banding units 13 which are provided in the vicinity of the folding station 4, are counted to accumulate a predetermined number of prints as a set, are packaged and banded in a set by set and are conveyed in sets towards an outlet (not shown).

At this point, it should be noted that the folding station 4, when cutting the overlapped continuous sheets of paper W and folding the cut sheets, gives rise to strong vibrations and large sounds. Here, however, since the machinery table 5 on which the folding station 4 is mounted and the machinery table 3 on which the printing stations 2 and 2' are mounted are separated, the above mentioned strong vibrations should not propagate to the printing stations 2 and 2'. In addition, since the folding station 4 is enclosed with the surrounding structure 7, the emission of the large sounds generated by the folding station 4 should be restrained, in spite of the fact that the entrance for the continuous sheets of paper W and the exit for the cut and folded prints are open. It this connection, it should be noted that an operation for the folding station 4 is carried out by an operator who enters through the door D within the enclosed structure 7.

In case the counting accumulation units 11 are housed in the enclosed structure 7, the sounds that are emitted from the counting accumulation units 11 should be restrained. In this connection, it may be noted that the prints are, as they are stacked one upon another, conveyed out through the exit of the enclosed structure 7.

Further, with the folding station 4 being capable of being provided independently of the series of the printing stations 2 and 2', the layout of the various elements which constitute the rotary press can be made as desired so as to be commensurate with the building. This may prevent an unnecessary space from being produced and would be capable of the effective utilization of a limited space. Also, in case the drive source 9 is divided for the printing stations 2 and 2', that is, the second drive sources 9 are made mutually independent, the printing stations 2 and 2' need not necessarily to be aligned in a row; this will enable the degree of freedom of layout of the various elements which constitute the rotary press to be enlarged.

In addition to the foregoing illustrative form of embodiment of the present invention as set forth above with reference to FIGS. 1 and 2, certain different illustrative forms of embodiment thereof are contemplated below.

Figure 3:
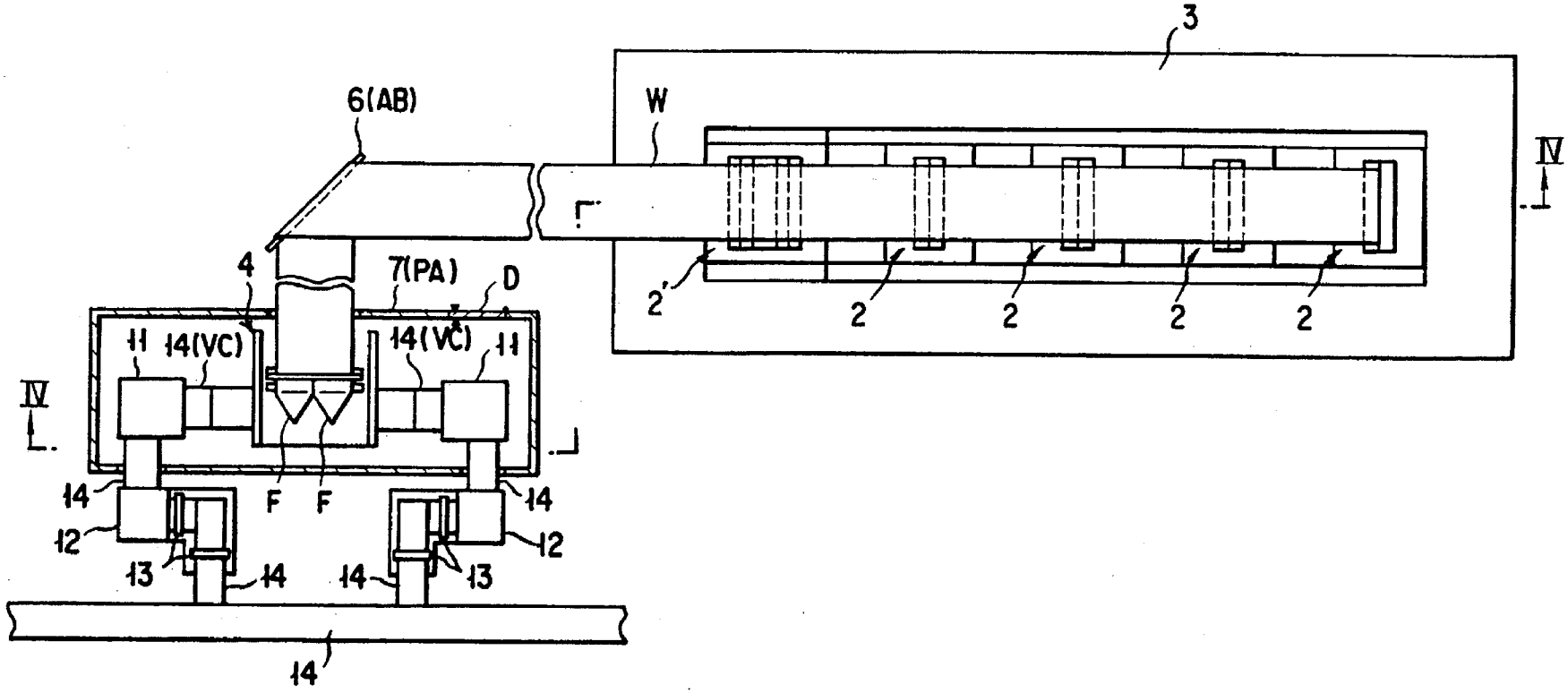
FIG. 3 is a top plan view, partly cut away, diagrammatically showing a rotary press in another illustrative form of embodiment according to the present invention.
Figure 4:
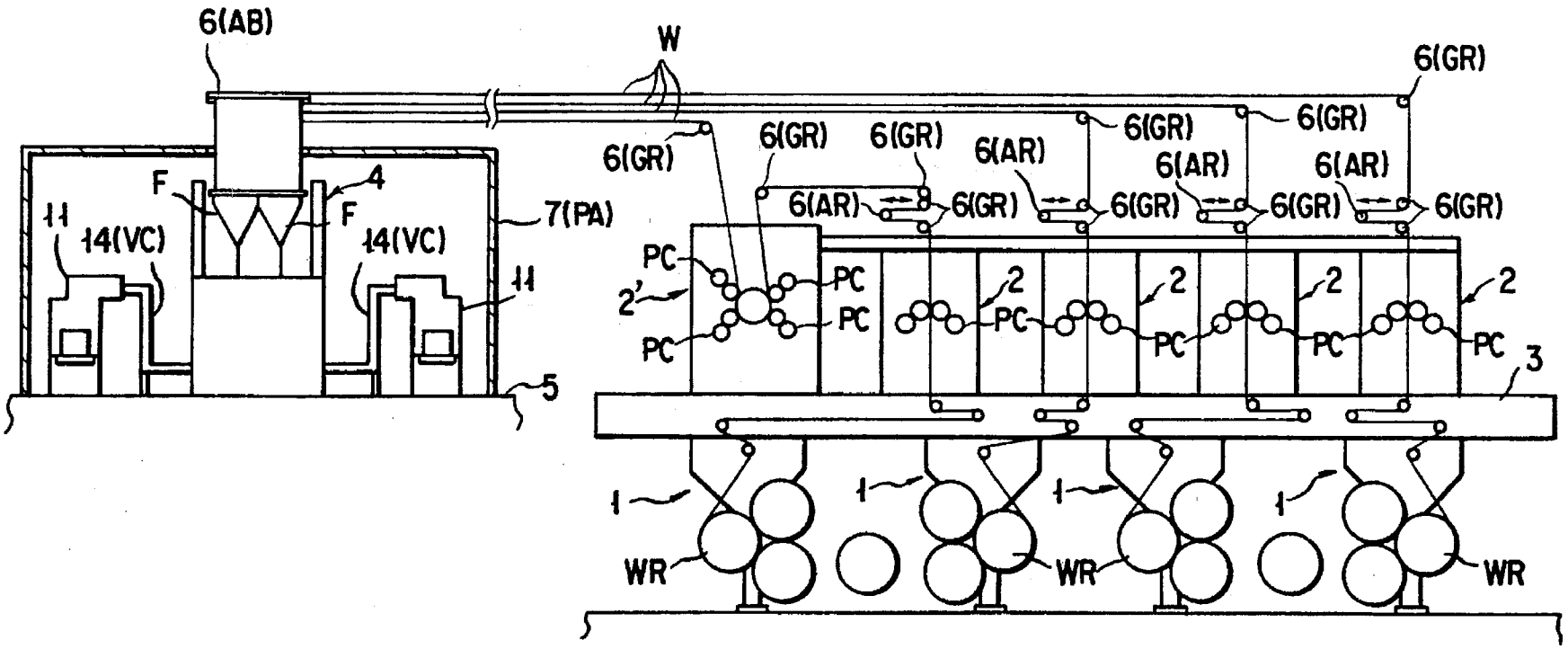
FIG. 4 is an elevational view in section, as taken along the line IV—IV and as viewed in the direction of the arrows in FIG. 3.

Specifically, the folding cylinder (not shown) in the folding station 4 may be arranged to have its axis that is not oriented perpendicular to the direction of the axes of the printing cylinders PC in the printing stations 2 and 2', thus for example, that is oriented parallel to the axes of the printing cylinders PC in the printing stations 2 and 2' as shown in FIGS. 3 and 4. In this case, in order to guide the continuous sheets of paper W onto the folding station 4, it has been shown above that the angle bar AB is provided in the guide mechanism 6 between the printing stations 2 and 2' and the folding station 4.

Also, while in FIGS. 3 and 4 the folding station 4 is shown as provided at a location that is out of the region which represents an extension of the row of the printing stations 2 and 2' which are arranged in series, the folding station 4 may be located (not shown) in the region which represents an extension of the row of the printing stations 2 and 2', even where the folding cylinder (not shown) in the folding station 4 is arranged to have its axis that is not oriented perpendicular to the axes of the printing cylinders PC in the printing cylinders 2 and 2'.

Likewise, while in FIGS. 1 and 2 the folding station 4 is shown as provided in the region that represents an extension of the row of the printing stations 2 and 2' that are arranged in series, the folding station 4 may be arranged at a location (not shown) which is out of the region that represents an extension of the row of the printing stations 2 and 2', where the folding cylinder (not shown) in the folding station 4 is arranged to have its axis that is perpendicular to the axes of the printing cylinders PC in the printing stations 2 and 2'.

Figure 5:
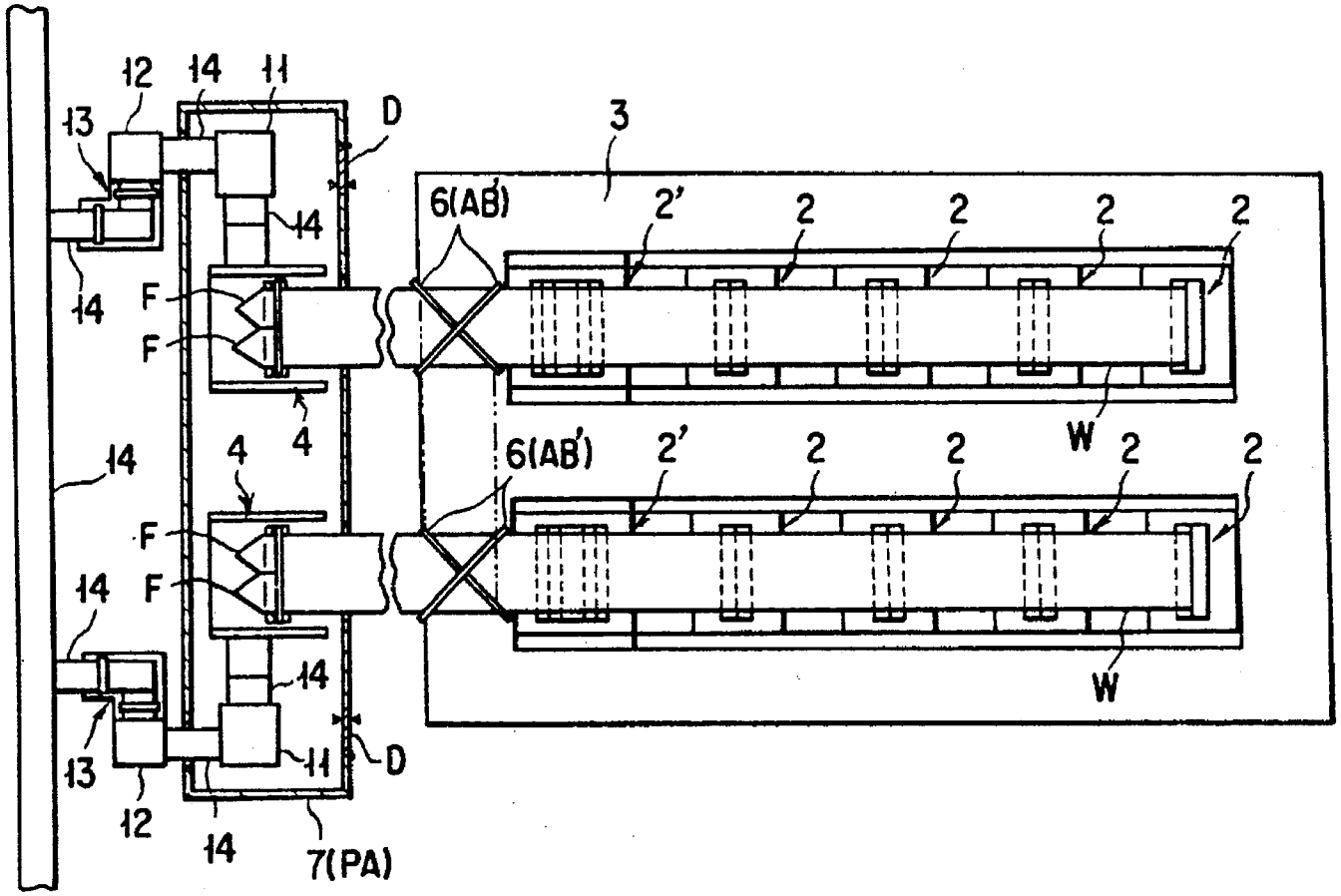
FIG. 5 is a top plan view, partly cut away, diagrammatically showing a rotary press in still another illustrative form of embodiment according to the present invention, in which all of a plurality of folding stations and counting accumulating units operatively associated therewith are incorporated in a surrounding enclosure structure in the rotary press having a pair of constructional units aligned therein.
Figure 6:
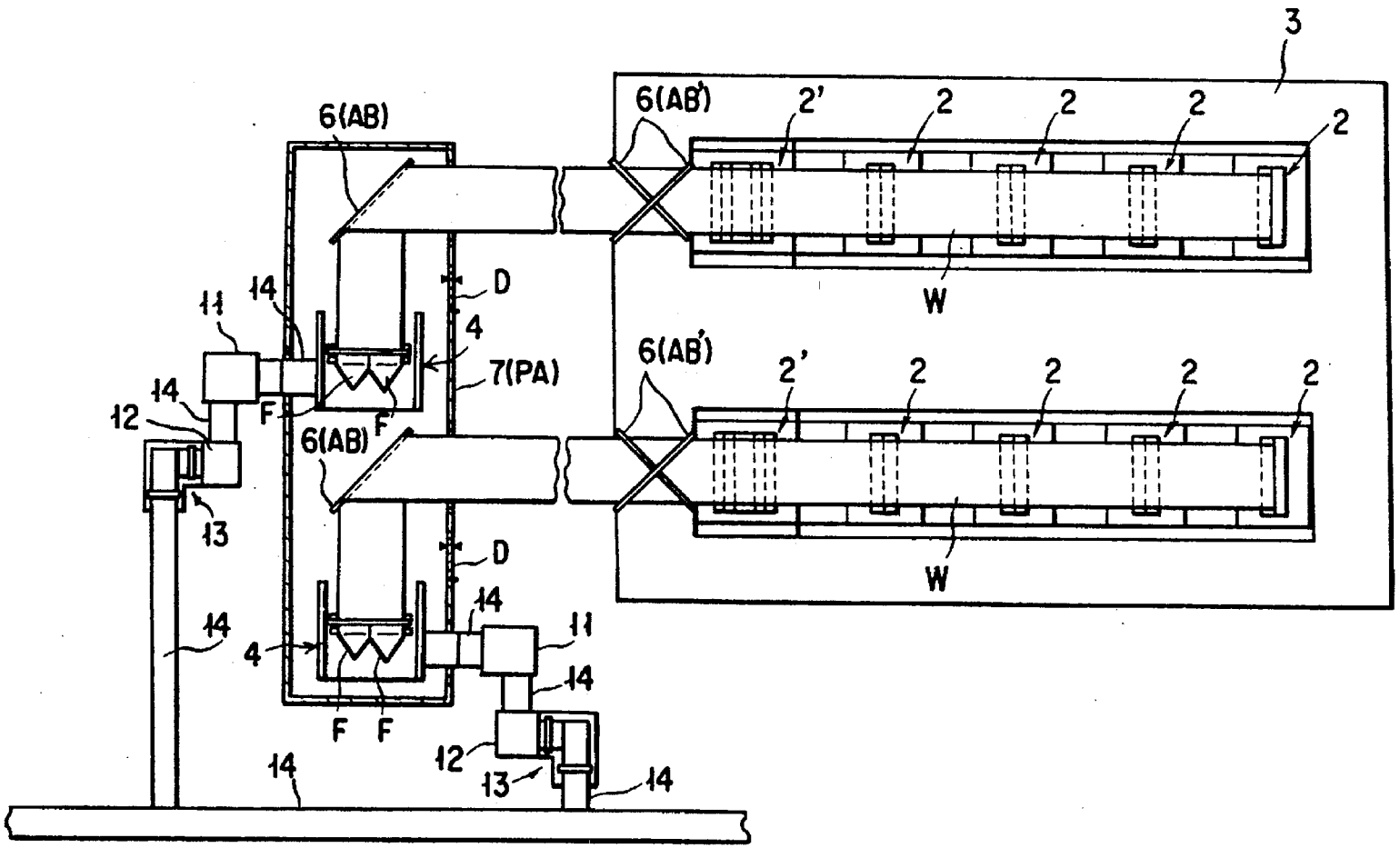
FIG. 6 is a top plan view, partly cut away, diagrammatically showing a rotary press in yet another illustrative form of embodiment according to the present invention in which a plurality of folding stations are incorporated in a surrounding enclosure structure in the rotary press having a pair of constructional units aligned therein.

Shown in FIGS. 5 and 6 are different illustrative forms of embodiment of the present invention in both of which a plurality of (two as shown) constructional units of the rotary press shown in FIGS. 1 and 2 are arranged to be parallel to each other.

A rotary press constituted by a plurality of constructional units, as shown in FIGS. 5 and 6, needs not to be arranged for each individual constructional unit, but may be arranged by distributing the printing stations 2 and 2' into a plurality of rows (not shown). In this connection, it should be noted that with the rotary press so arranged, the other drive source 9 which is a drive source for operating the printing stations 2 and 2' may be constituted by drive sources which are operated as coupled with the respective rows. However, it is then preferable that the second drive source 9 be constituted by mutually independent drive sources each capable of driving each individual printing station 2, 2' separately.

With any illustrative form of embodiment whichever that may be taken, as shown in FIG. 17 the drive source 8 for operating the folding station 4 is made independent separately from the second drive source 9 and also independent for each individual folding station 4.

On the other hand, in a rotary press constituted by a plurality of constructional units thereof, a guide mechanism 6 is formed in which the continuous sheets of paper W which are printed in the printing stations 2 and 2' of one constructional unit are guided onto the folding station 4 of another constructional unit and were lapped over the continuous sheets of paper W which are printed in the printing stations 2, or 2 and 2' of another constructional unit to produce prints. More specifically, a guide mechanism 6 is formed which is provided with angles bars AB' as shown in FIGS. 5 and 6.

According to this guide mechanism 6, it is made possible to produce prints of which the number of pages exceeds the number of pages which can be printed by a single constructional unit of the rotary press. In addition, as in the rotary press shown in FIGS. 5 and 6, where there is a limit in the number of pages which can be printed in four colors by one constructional unit, it is made possible to produce prints containing the number of four-colored pages which exceeds this limit. Thus, the kinds of construction of the prints that can be produced can be increased.

In connection with the above, it should be noted that in a rotary press which is capable of producing such prints, it is preferred that the second drive source 9 for operating the printing stations 2 and 2' be constituted by divided drive sources which are capable of independently operating the respective individual printing stations 2 and 2' so that unnecessary printing stations 2 and 2' in an operation of the rotary press may not have to be operated.

In the above mentioned illustrative forms of embodiment of the present invention which are shown in FIGS. 5 and 6, the rotary press is shown as so constructed that the prints (not shown) may be discharged from one side of the folding station 4 and that the instruments in the subsequent stages such as the counting accumulation units 11 may be connected only to a discharge location at one side of the folding station 4. However, in a rotary press, too, which are constituted by a plurality of constructional units thereof, a like plurality of folding stations 4 can be constructed, as in the folding station 4 shown in FIGS. 1 and 2 or FIGS. 3 and 4, so that the prints may be discharged from both sides thereof (not shown).

Similarly, the folding station 4 which is shown in FIGS. 1 to 4 may be so constructed, as in the folding station 4 shown in FIGS. 5 and 6, that the prints may be discharged from one side thereof (not shown).

Also, the folding stations 4 need not to be installed at locations such as the positions of installation as shown in FIGS. 5 and 6. On the contrary, for example, they may be installed as arranged in a row that is parallel to the row of the printing stations 2 and 2' (not shown). In this case, there is no restriction whatsoever in orienting the folding stations 4 relative to the direction in which the printing stations are arranged, and there is no need for all the folding stations 4 to be oriented in an identical direction.

Further, the surrounding structure 7 shown in FIG. 5 is formed to enclose all of a plurality of the folding stations 4 and the counting accumulation units 11 operatively associated therewith, whereas the surrounding structure 7 shown in FIG. 6 is formed to enclose a plurality of the folding stations 4. However, it should be understood that the same is not limited to either of the illustrated forms of embodiment shown there. For example, the form of embodiment of the enclosed structure 7 shown in FIGS. 2 and 4 may be applied to the embodiments of the present invention shown in FIGS. 5 and 6 and may also be designed to surround the folding stations 4 as well as the counting accumulation units 11 separately associated therewith, respectively. Alternatively, the form of embodiment of the surrounding structure 7 shown FIGS. 7 and 9 can be applied so that each of the folding stations 4 alone may be individually enclosed.

Figure 7:
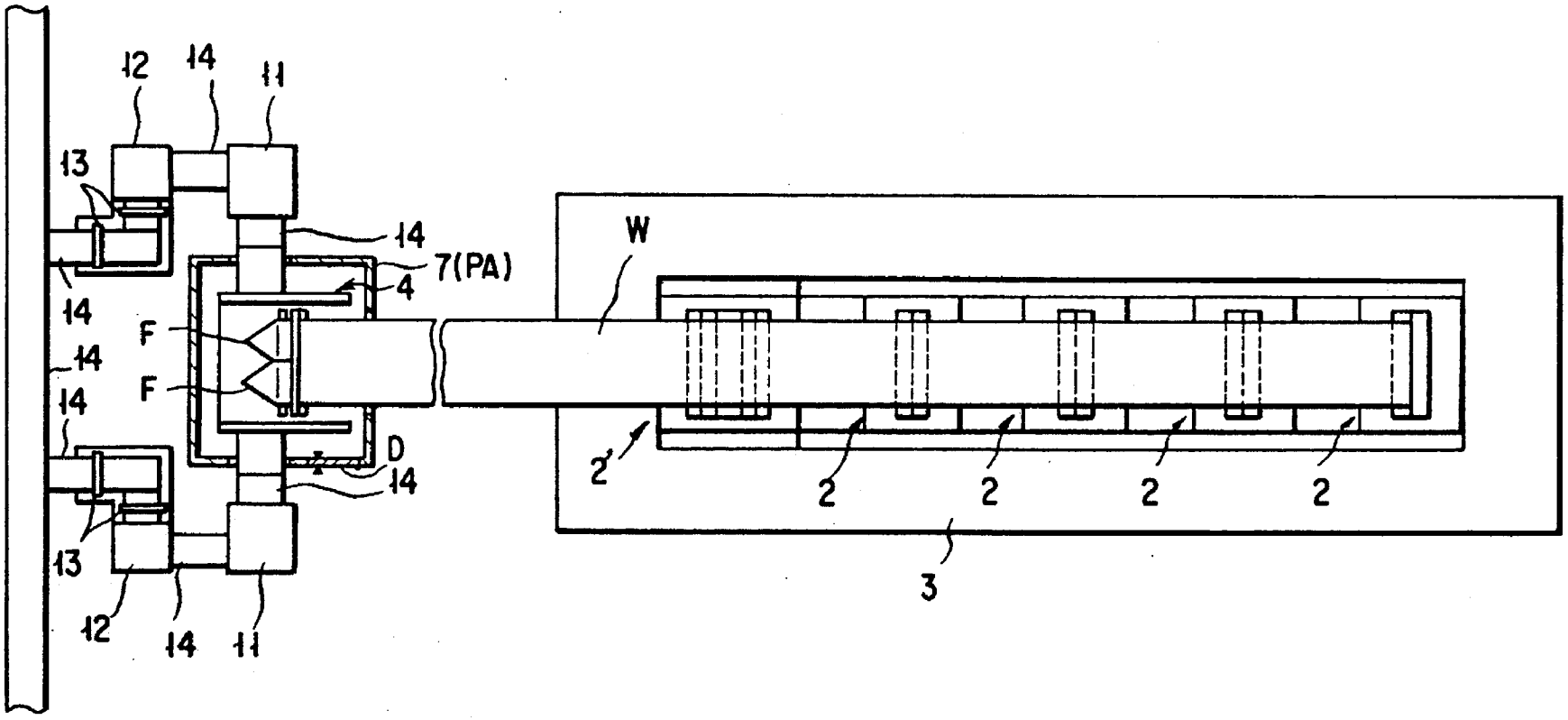
FIG. 7 is a top plan view, partly cut away, diagrammatically showing a rotary press in a further illustrative form of embodiment according to the present invention in which a surrounding enclosure structure as shown in the illustrative form of embodiment of FIG. 1 is designed to surround only a folding station.
Figure 8:
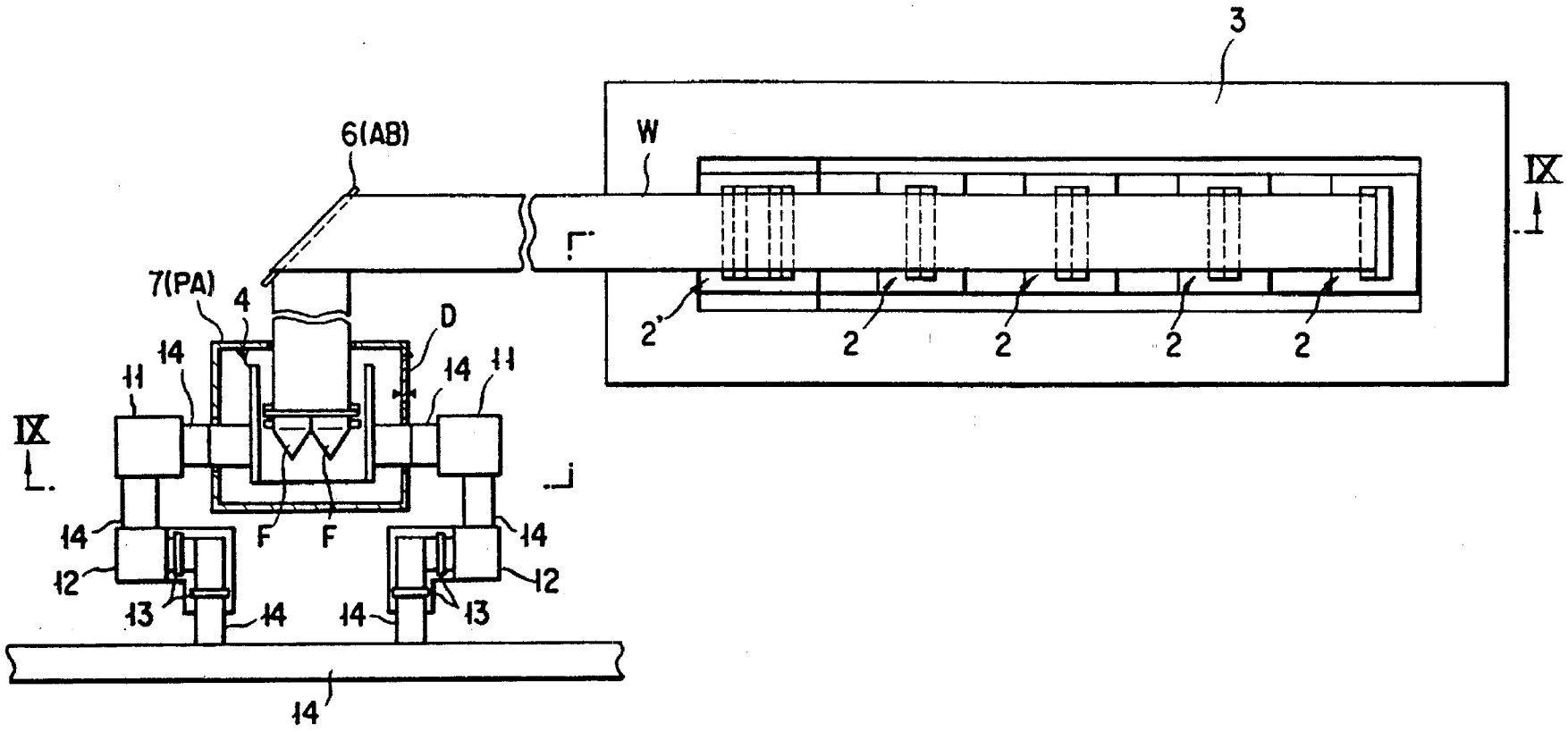
FIG. 8 is a top plan view, partly cut away, diagrammatically showing a rotary press in a still further illustrative form of embodiment according to the present invention in which a surrounding enclosure structure as shown in the illustrative form of embodiment of FIG. 3 is designed to enclose only a folding station.
Figure 9:
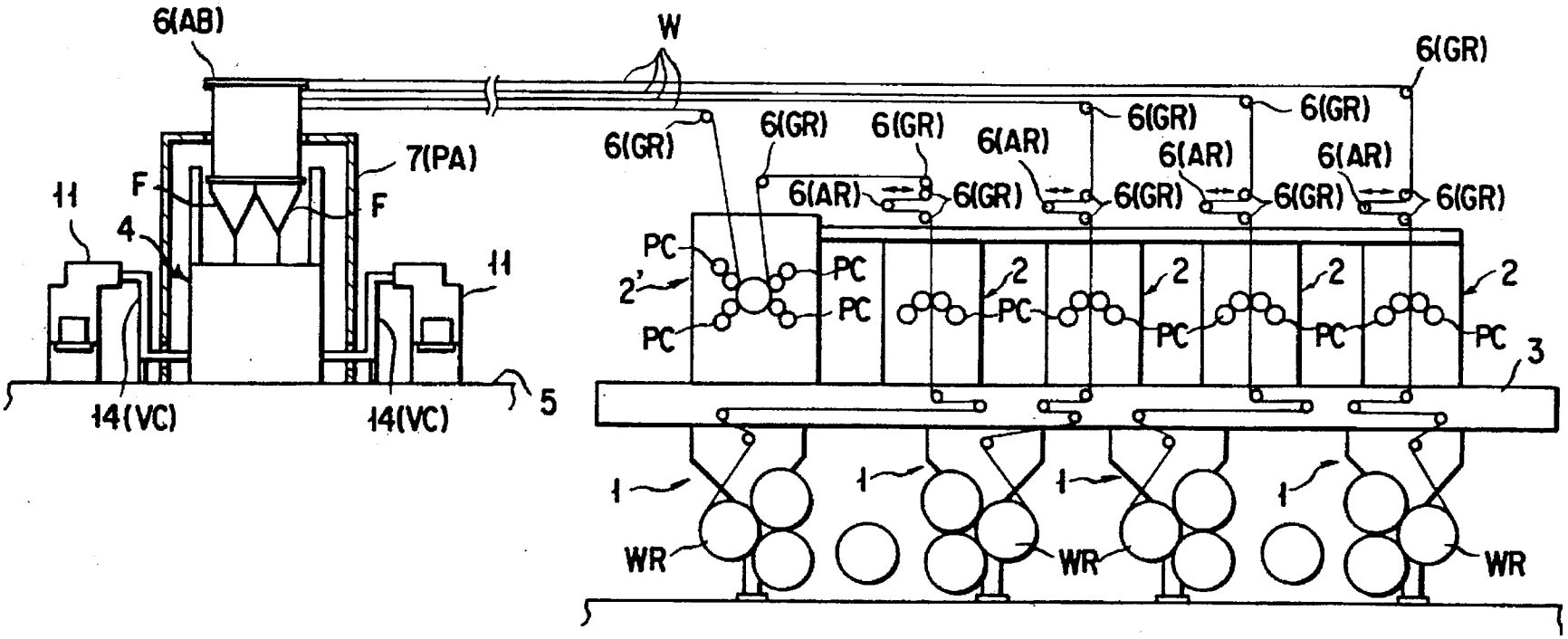
FIG. 9 is an elevational view in section as taken along the line IX—IX and as viewed in the direction of the arrows in FIG. 8.

The illustrated form of embodiment of FIG. 7 represents a form of embodiment of the present invention in which in a rotary press as shown in FIGS. 1 and 2, the folding station 4 alone is enclosed with the surrounding structure 7. The illustrated form of FIGS. 8 and 9 represents a form of the embodiment of the present invention in which in a rotary press as shown in FIGS. 3 and 4, the folding station 4 alone is enclosed with the surrounding structure 7. The surrounding structure 7 shown in FIGS. 7 to 9 may, as mentioned before, be applied to a rotary press as shown in FIGS. 5 and 6. In connection with the above, it should be noted that the side elevational view of the illustrative form of embodiment shown in FIG. 7 is similar to that shown in FIG. 2 and hence is omitted.

On the other hand, it should be understood that the present invention is embodied in an arrangement in which the folding station or stations 4 is/are installed in a room separate from the printing stations 2 and 2' with the ceiling, floor and walls which define the room being substituted for the surrounding structure 7.

In such a modification of the embodiments of the present invention, the ceiling, floor and walls of the room in which the folding station(s) 4 should be enclosed are provided anywhere with a window through which an operation of the folding stations(4) may be viewed from the outside, an entrance for the continuous sheets of paper W, an exit for the prints and a door through which an operator may enter into and exit from the room. Also, it may be unnecessary to note that as in the case of the enclosed structure 7, the counting accumulation unit(s) 11 may be installed in the room for accepting the folding station(s) 4.

Further, in any of the illustrative forms of embodiment whichever that may be taken, that is, in a form of embodiment as well in which the folding station(s) 4 should be installed within the surrounding structure 7, or in a form of embodiment as well in which the folding station(s) 4 should be installed within a room that is separate from the printing stations 2 and 2', a description has been made above with respect to an instrument which is installed together with the folding station(s) 4 in a subsequent stage as being only the counting accumulation units 11. It will readily be understood, however, that such an instrument is not limitative to the counting accumulation units 11 but may also include the packaging unit 12, the banding unit 13 and the conveyer unit 14, any one or more of which may also be installed inside of the surrounding structure 7 or within the room.

Also, in any illustrative form of embodiment whichever that has been described above, more effective noise preventive effect can be achieved, for example, by including an active noise eliminating functional element in the enclosure structure 7 or the room in which the folding station(s) 4 should be installed.

Figure 10:
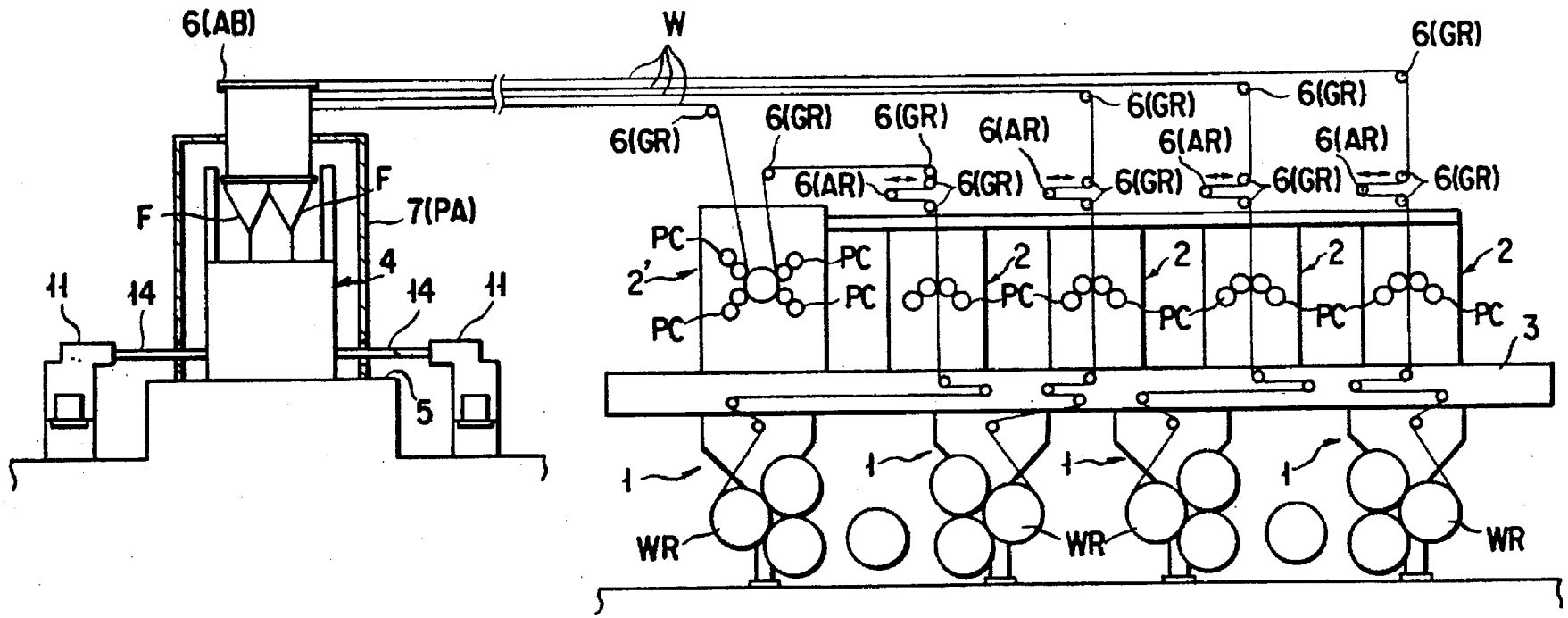
FIG. 10 is a front elevational view, partly cut away, diagrammatically showing a rotary press in a yet further illustrative form of embodiment according to the present invention in which the installation level for an instrument in a downstream stage as shown in the illustrative form of FIG. 9 is lowered below the installation level for the folding station.
Figure 11:
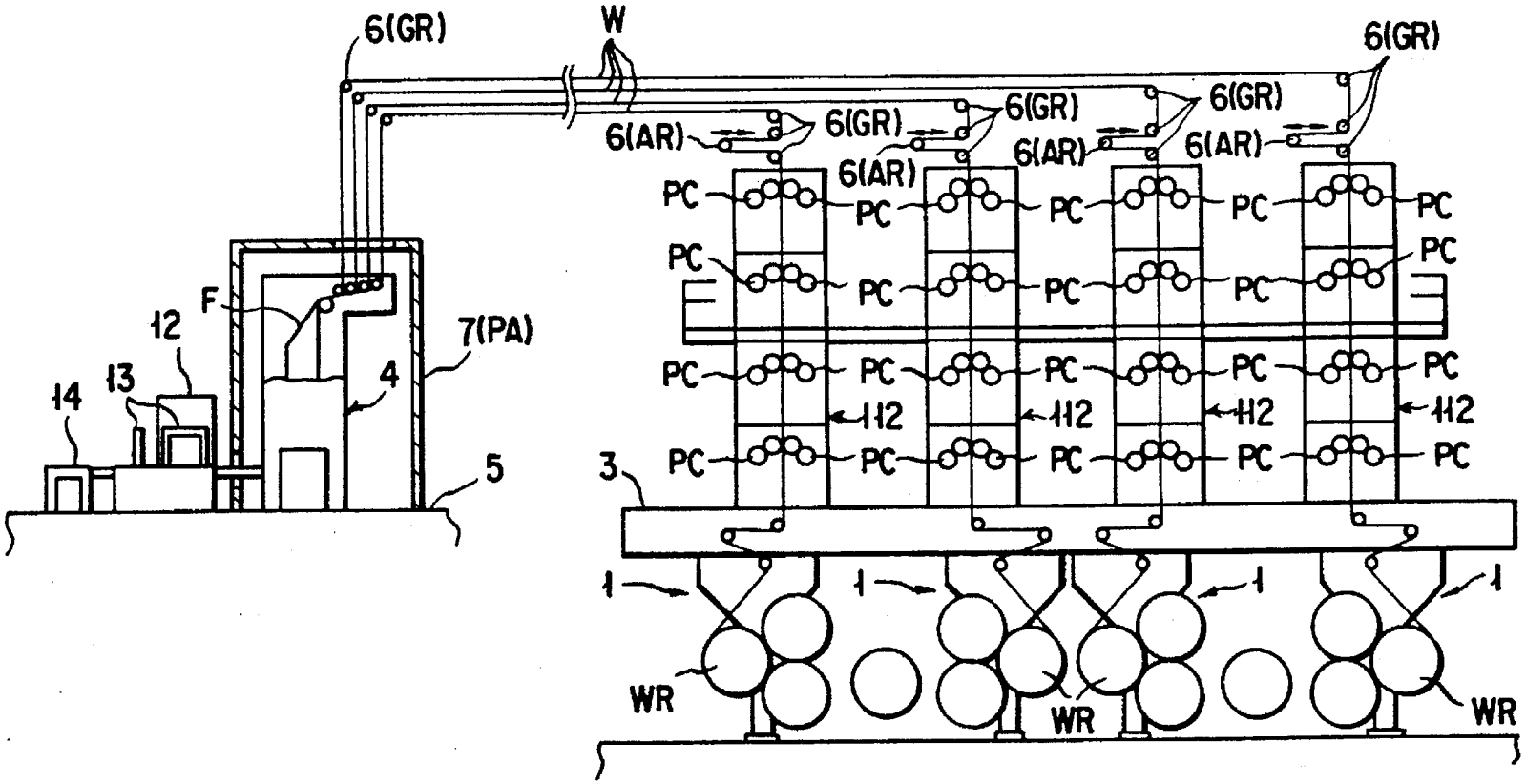
FIG. 11 is a front elevational view, partly cut away, diagrammatically showing a rotary press in a still yet further illustrative form of embodiment according to the present invention in which each of the printing stations as shown in the illustrative form of embodiment of FIG. 2 is substituted by another form of printing stations.
Figure 12:
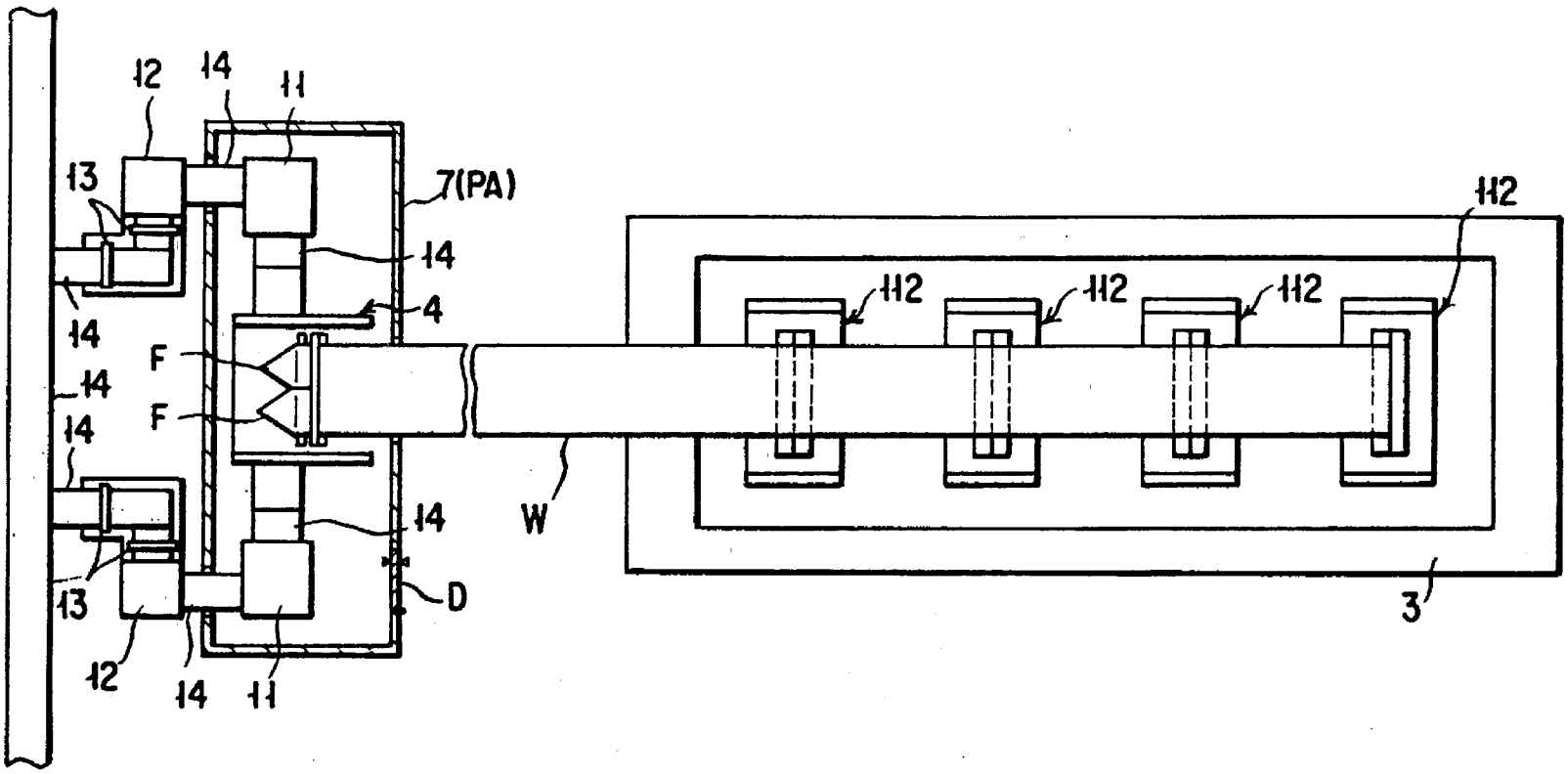
FIG. 12 is a top plan view, partly cut away, diagrammatically showing in a detail a portion of the illustrative form shown in FIG. 11.

An illustrative form of embodiment of the present invention as shown in FIG. 10 represents an arrangement in which in a rotary press as shown in FIGS. 8 and 9, the level of installation for the folding station 4 and the level of installation for any instrument in a subsequent stage operatively associated therewith are differentiated in height and in which the prints discharged from the folding station 4 is transported into the counting accumulation units 11, without passing through the conveyance units 14 which are constituted by a pair of rising conveyers VC (see FIG. 9). In FIG. 10, when compared with FIG. 9, a form of embodiment is shown in which the level of installation for the subsequent stage instrument is lowered, but, when compared with FIG. 4, a form of embodiment is shown in which the level of installation for the folding station 4 is raised (not shown) so that the prints discharged from the folding station 4 may be transported to the counting accumulation units 11 without passing through the conveyance units 14 which are constituted by the rising conveyers VC.

At this point it may be apparent that the illustrated forms of embodiment of FIGS. 1 to 10 are shown as if the level of installation for the printing stations 2 and 2' and the level of installation for the folding station(s) 4 should be identical in height. It should be apparent, however, that the both levels of installation may be differentiated in height and it is then suitably determined by the specification of the rotary press including the printing stations 2 and 2' and the folding station(s) 4, the specification of the subsequent stage instruments, the specification of the building, and so forth which of them is to be raised.

The illustrative forms of embodiment of the present invention as shown in FIGS. 11 to 14 are designed to replace the printing stations 2 and 2" in the embodiments of FIGS. 1 to 4 with four printing stations 112 in each of which four stacked printing means which are capable of simultaneously printing both sides of each of continuous sheets of paper W whereby both sides of each of the continuous sheets of paper W are printed in four colors.

Figure 13:
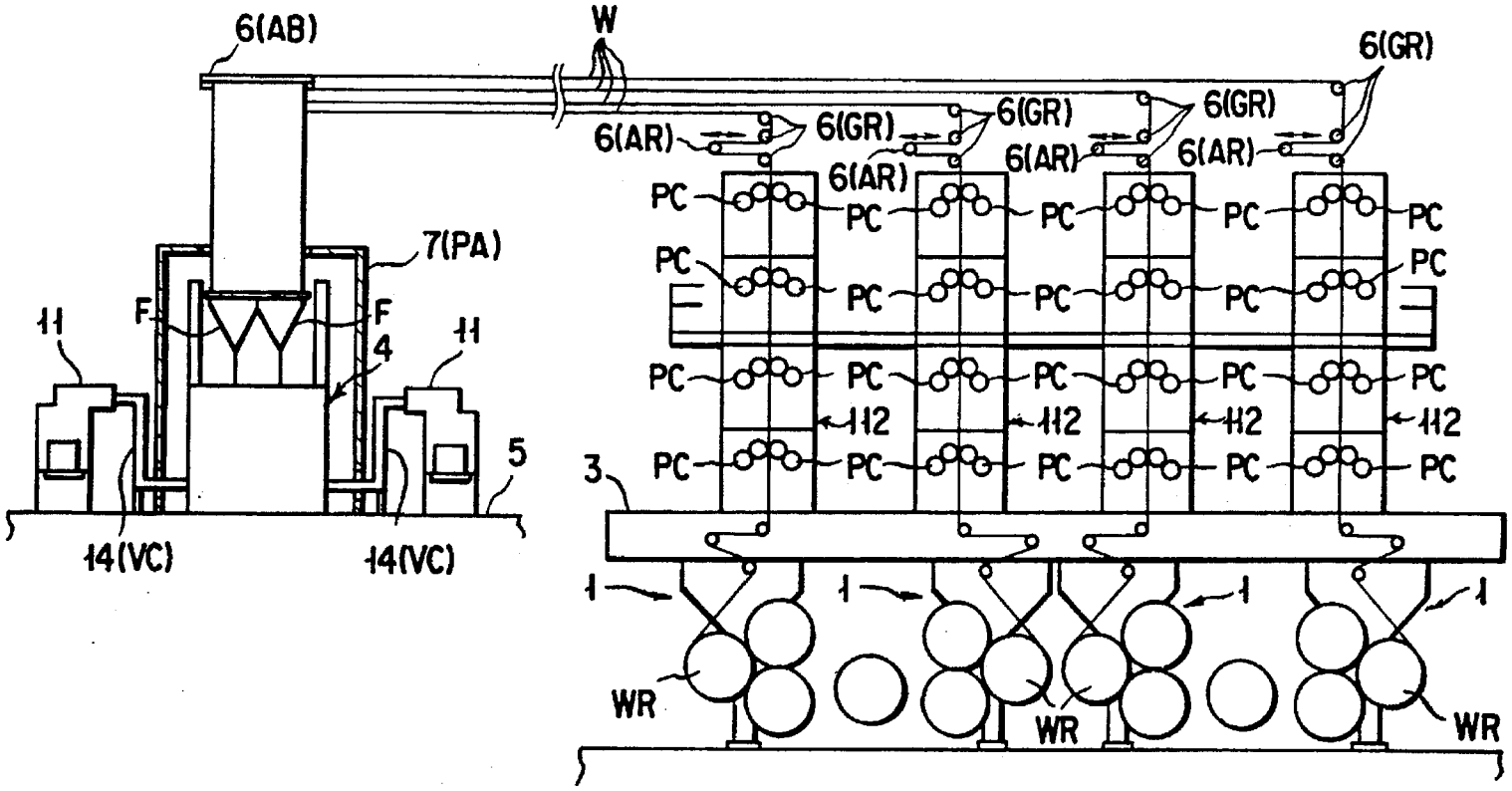
FIG. 13 is a front elevational view, partly cut away, diagrammatically showing a rotary press in another illustrative form of embodiment according to the present invention in which each of the printing stations of the illustrative form of embodiment as shown in FIG. 9 is substituted by another form of printing stations.
Figure 14:
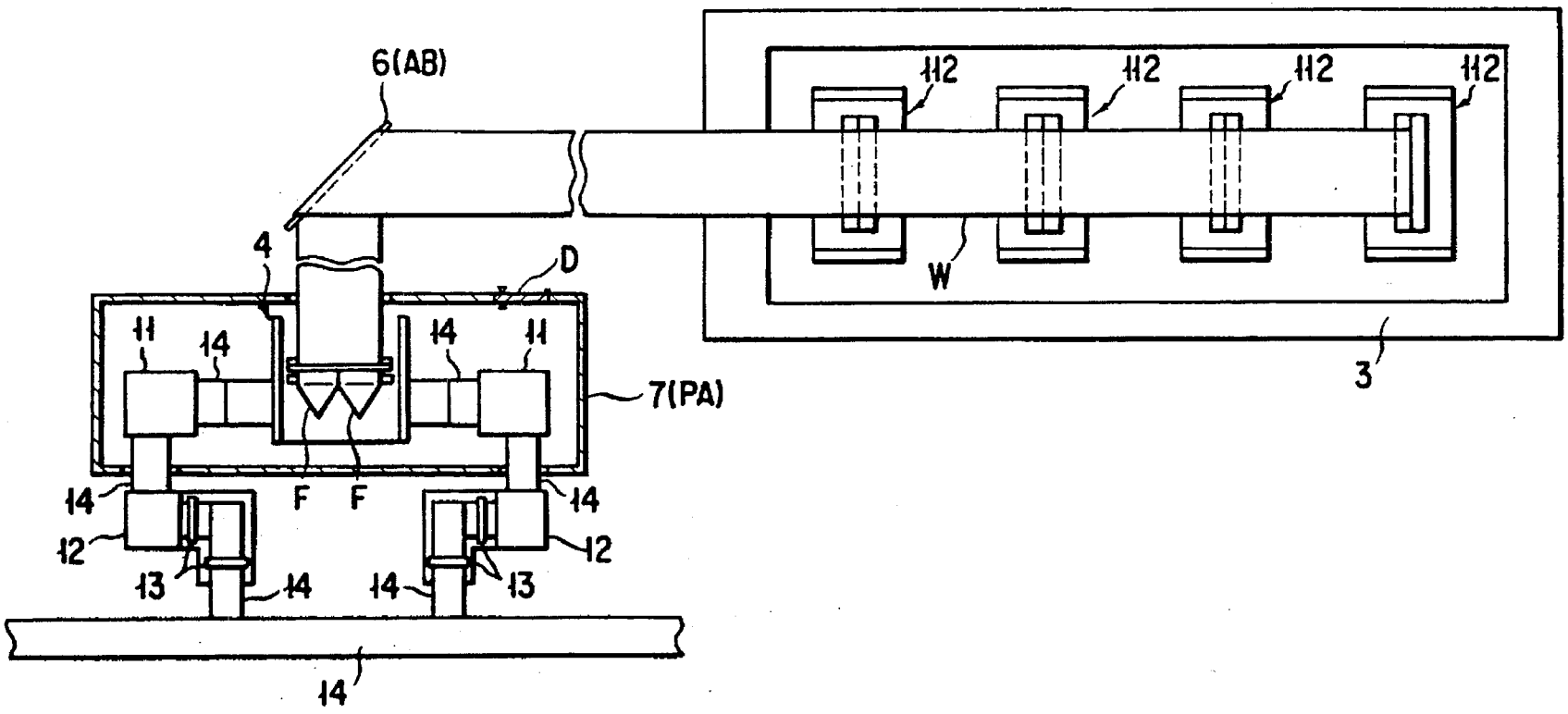
FIG. 14 is a top plan view, partly cut away, diagrammatically showing a rotary press in still another illustrative form of embodiment according to the present invention in which a surrounding enclosure structure as shown in the illustrative form of embodiment of FIG. 13 is designed to enclose all of the folding station and the counting accumulation units operatively associated therewith.
Figure 15:
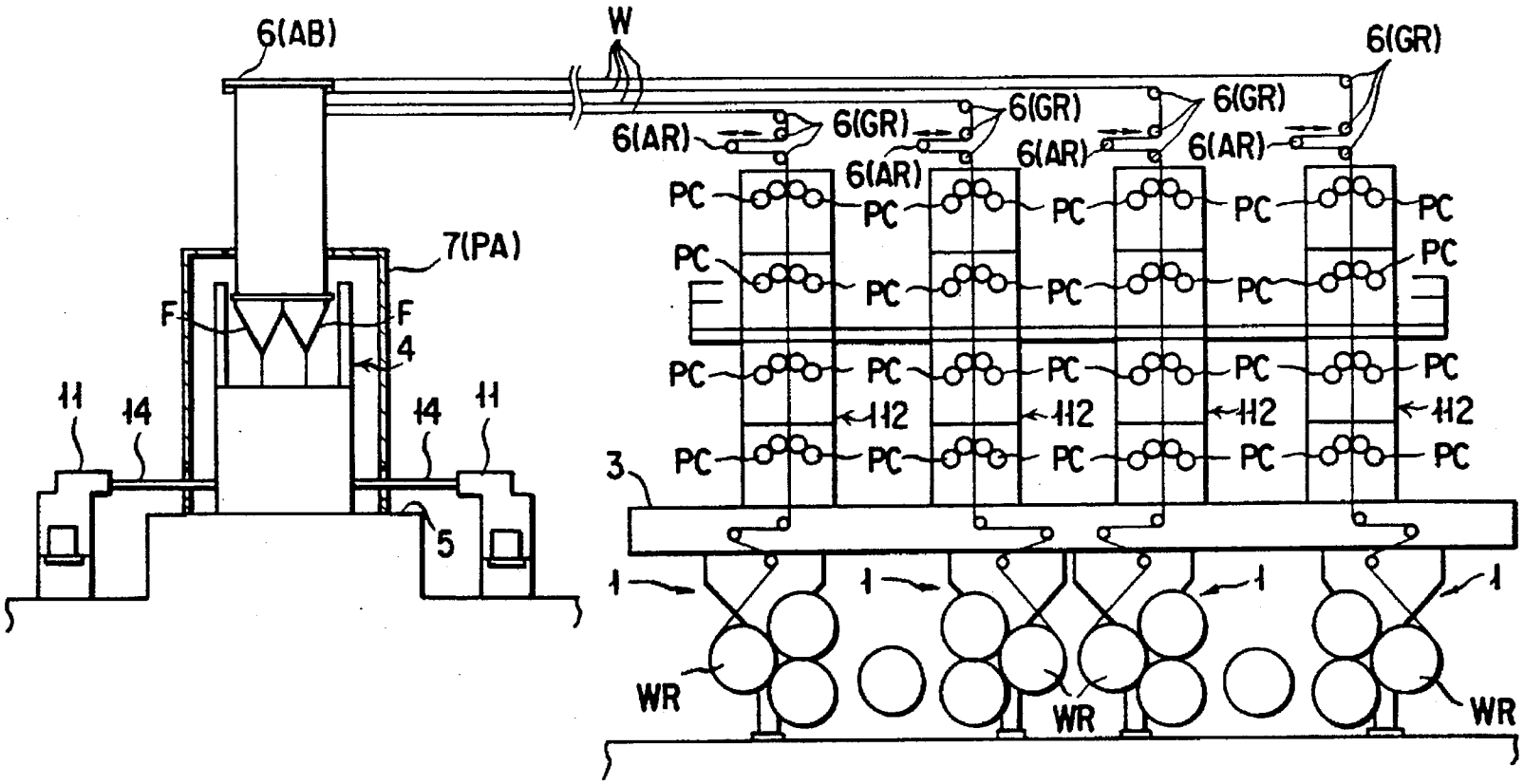
FIG. 15 is a front elevational view, partly cut away, diagrammatically showing a rotary press in yet another form of embodiment according to the present invention in which the installation level for an instrument in a downstream stage in the illustrative form of embodiment of FIG. 13 is lowered below the installation level for the folding station.
Figure 16:
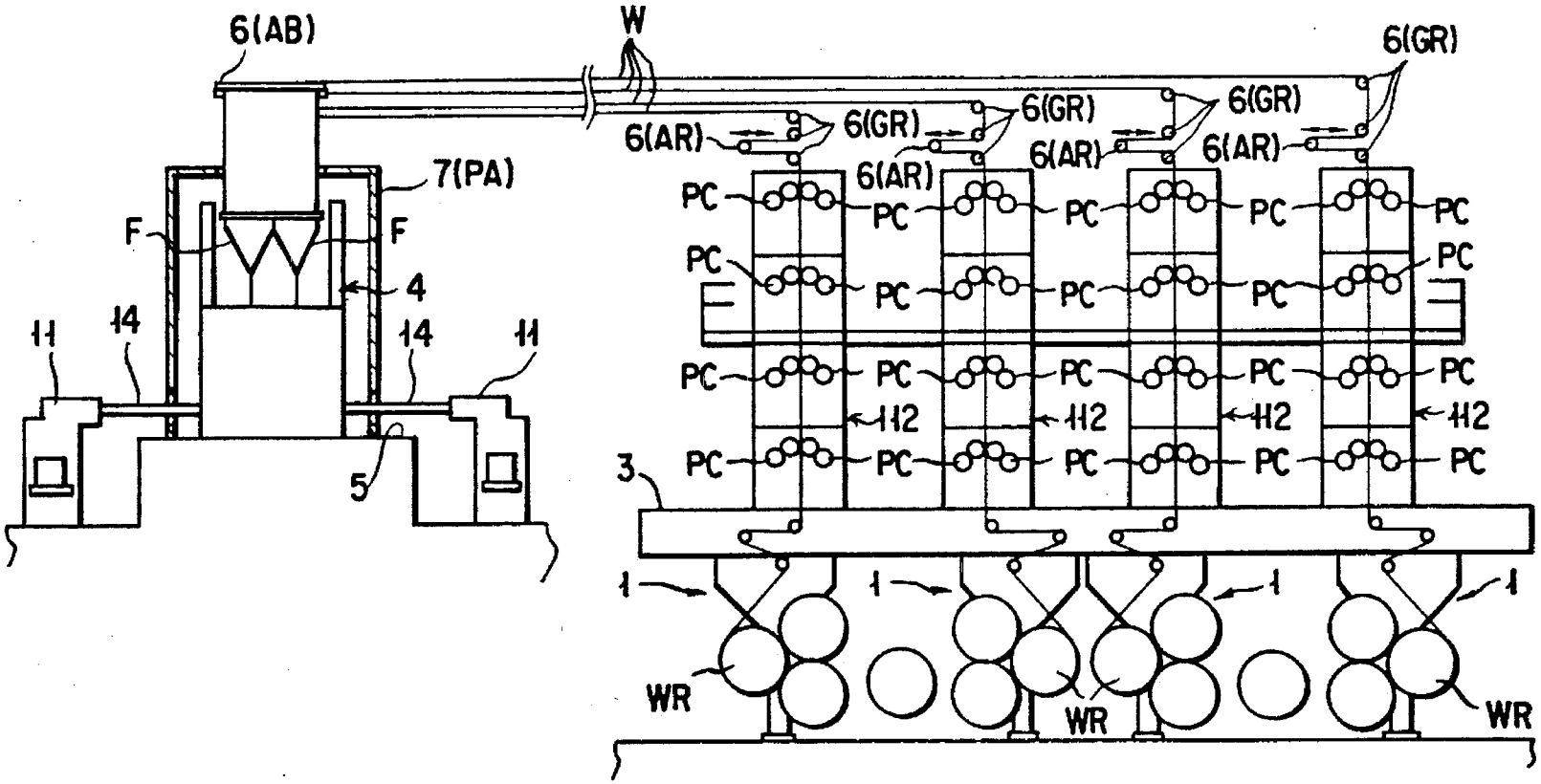
FIG. 16 is a front elevational view, partly cut away, diagrammatically showing a further form of embodiment according to the present invention in which the installation level for the folding stations is raised above the installation level for the instrument in the downstream stage.

The illustrative forms of embodiment as shown in FIGS. 15 and 16 represent further embodiments of the present invention in which in a rotary press as shown in FIGS. 13 and 14, the level of installation for the folding station 4 and the level of installation for the subsequent instruments are differentiated in height and in which the prints discharged from the folding station 4 is transported to the counting accumulation units 11 without passing through the conveyance units 14 which are constituted by the rising conveyers VC. In the embodiment of FIG. 15, when compared with that of FIG. 13, the level of installation for the subsequent stage instruments is lowered. In the embodiment of FIG. 16, when compared with that of FIG. 13, the level of installation for the folding station 4 is heightened.

At this point it may be apparent that the illustrated forms of embodiment of FIGS. 11 to 15 are shown as if the level of installation for the printing stations 112 and the level of installation for the folding station 4 should be identical in height whereas the illustrated embodiment of FIG. 16 is shown as if the level of installation for the folding station 4 is higher than the level of installation for the printing stations 112. It should be apparent, however, that such both levels of installation may be made identical or differentiated in height. If they are different in height, it is then suitably determined which of them is to be heightened by the specification of the rotary press including the printing stations and the folding station, the specification of the subsequent stage instruments, the specification of the building, and so forth.

Also, in the illustrative forms of embodiment as shown in FIGS. 11 to 16, as in the illustrated forms of embodiment of FIGS. 1 to 8, the folding station 4 may be housed in a room which is separate from the printing stations 112. In such a modification of the embodiments of the present invention, the ceiling, floor and walls which define the room in which the folding station 4 should be enclosed are provided anywhere with a window through which an operation of the folding station(s) 4 may be viewed from the outside, an entrance for the continuous sheets of paper W, an exit for the prints and a door D through which an operator may enter into and exit from the room. Also, it may be unnecessary to note that any one or more of the counting accumulation unit(s) 11, the packaging unit(s) 12, the banding unit(s) 13 and the conveyance unit(s) 14 may then be installed in the surrounding structure 7 or the room for accepting the folding station 4.

Further, while the illustrative forms of embodiment of the rotary press of FIGS. 11 to 16 are shown as having the level of installation for the printing stations 112 like that in the embodiments of FIGS. 1 to 4, the fact that such an installation level and its direction are not limited to the level and direction as shown in FIGS. 11 to 16 is like that in a rotary press as shown in FIGS. 1 to 4.

Still further, the illustrative forms of the rotary press of FIGS. 11 to 16 are shown as having a single constructional unit of the rotary press, they may be modified as having a plurality of constructional units which are arranged parallel to one another as in a rotary press as shown in FIGS. 5 and 6. In this case, the construction, the level of installation and the direction of installation of the folding station 4 are not limited to as shown; this fact is like that as shown in FIGS. 5 and 6.

On the other hand, it will be apparent that a printing station that constitutes a rotary press is not limited to those in the illustrative forms of embodiment as described before. For example, in addition to each of the printing stations 2, 2' and 112 described in connection with the above mentioned illustrative forms of embodiment, there can be contemplated a printing station 112' that is capable of printing on both sides of a continuous sheet of paper W in a pair of colors as has been set out in connection with the prior art; a printing station (not shown) which comprises three stacked printing means that are capable of simultaneously printing on both sides of a continuous sheet of paper W to enable the both sides of the continuous sheet of paper W to be printed in three different colors; a printing station (not shown) which has a printing means that is capable of printing only one side of a continuous sheet of paper W; a printing station (not shown) which comprises a suitable number of printing means of a first class capable of simultaneously printing on both sides of a continuous sheet of paper W and a suitable number of printing means of a second class capable of printing only one side of the continuous sheet of paper W and in which the printing means of the first class and the printing means of the second class are stacked in a suitable combination one upon another to enable one and the other sides of the continuous sheets of paper W to be printed in a number of different colors; a printing station which has printing means that are capable of printing in a single color on one area and in a pair of colors on another area of a continuous sheet of paper W; and so forth. A suitable number of printing stations are selected from these different types and arranged properly. It should be noted at this point that a printing station is not limited to ones which are capable of printing a particular continuous sheet of paper W that is called "W-width rolled sheet of paper".

Likewise, it should be apparent that a paper feed station 1 and a folding station 4 are not limited to those described in connection with the above mentioned illustrative forms of embodiment. For example, the paper feed station 1 may be, as shown, of a form which has three rolls of paper WR loaded thereon, but may alternatively be of a form which has two rolls of paper WR loaded thereon. It may also be of a form (not shown) which has a frame that is common to a printing station and arranged as an annex below a printing means, or a form (not shown) which is leveled identically with a printing station and a folding station.

On the other hand, the folding station 4 is shown as comprised of only a pair of formers (i. e. triangular plates) F, but may alternatively be of a form (not shown) in which three or four formers (i. e. triangular plates) are arranged, a form in which two formers (i. e. triangular plates) F are primarily arranged and two or three such sets are additionally laid up and down, a form (not shown) in which two formers (i. e. triangular plates) F are arranged and two such sets are additionally arranged back and forth, a form (not shown) in which a single former (i. e. triangular plate) F is disposed, a form (not shown) in which a single former (i. e. triangular plate) F is laid up or down, a form in which a single former (i. e. triangular plate) F is laid back and forth.

In the above described forms of embodiment, the operation of a rotary press as shown in FIGS. 3, 4 and 7 to 16 requires that the first drive source 8 for operating the folding station 4 and the second drive source 9 for operating the printing station 2, 2' and 112 should, as shown in FIG. 17, be coupled with the control means 10, thus as in a rotary press as shown in FIGS. 1 and 2. Further, with the printing stations 112 having a plurality of printing means as in a rotary press as shown in FIGS. 11 to 16 and having a plurality of second drive sources 9 individually therefor, each second drive source 9 is required to be coupled individually with the control means 10.

Also, the operation of a rotary press as shown FIGS. 5 and 6 requires the first drive source 8 for operating each folding station 4 and the individual second drive source 9 for operating each of the printing stations 2 and 2' separately to be coupled to the control means 10.

The operation of each individual illustrative form of embodiment of the present invention constructed as mentioned above is carried out as set out below.

The continuous sheets of paper W respectively drawn out of the rolls of paper WR respectively loaded on the paper feed stations 1 will be guided via the corresponding printing stations 2 and 2' or 112 onto the folding station (s) 4. With a rotary press as shown in FIGS. 5 and 6 as having a plurality of rotary press constructional units, when the continuous sheets of papers W which are passed over the printing stations 2 and 2' of one rotary press constructional unit are to be guided onto the folding station 4 of another rotary press constructional unit, those continuous sheets of paper W which are guided by the angle bars AB' of the first rotary press constructional unit towards the second rotary press constructional unit will be, as shown by the two dotted chain line in FIG. 5, guided by the angle bars AB' of the second rotary press constructional unit towards the folding station 4 of the second rotary press constructional unit.

After the two sets of the continuous sheets of paper W have been guided onto the respective folding stations 4, the rotary press will be operated under the control of the control means 10. Then, the printing stations 2 and 2' or 112 and the folding stations 4 will be activated simultaneously and operated in a matched state. If the second drive source 9, that is, the drive source for the printing stations 2 and 2' or 112 are divided into individual drive sources respectively therefor that are mutually independent, only those of the printing stations 2 and 2' or 112 which are specified for selection to operate will be operated together with the folding stations 4. This act of specifying for selection will be commanded by the input means 10' that is coupled with the control means 10.

With the rotary press brought into operation, the printing stations 2 and 2' or 112 will be operated to print on the continuous sheets of paper W and the folding stations 4 will be operated to cut the printed continuous sheets of paper W and to fold the cut sheets for discharge as prints. The discharged prints, by being transported by the conveyance units 14 to pass through the counting accumulation units 11, the packaging units 12 and the banding units 13 which are disposed in the vicinity of the respective folding stations 4, will be counted to accumulate a predetermined number of the prints as a set and they will be banded in a set by set, the sets being conveyed towards an outlet or outlets (not shown).

Also, although the folding stations 4, when cutting the overlapped continuous sheets of paper W and folding the cut sheets, is strongly vibrated and also emits large sounds, it will be apparent that with the machinery table 5 for installing the folding stations(s) 4 thereon and the machinery table 3 for installing the printing stations 2 and 2' or 112 thereon being different in level the strong vibrations referred to above will not be propagated to the printing stations 2 and 2' or 112 whereas with the folding station(s) 4 enclosed within the surrounding structure 7 the emission of the large sounds will effectively be restrained even though the surrounding structure 7 is open where the entrance(s) for the continuous sheets of paper W and the exit(s) for the resultant prints exist. In this connection, it will be noted that an operator who handles the folding station(s) 4 can enter into and exit from the enclosed structure 7 through the door D provided therein.

In case the counting accumulation units 11 are disposed within the enclosure structure 7 as shown in FIGS. 3 to 5, 11, 12 and 14, it should be seen that the emission of the sounds that are generated by such counting accumulation units 11 will be restrained as well. In this case, note also that the prints will, in a stacked state, be conveyed out of the print exit of the enclosed structure 7.

Further, since the folding station(s) 4 can be mounted wholly independently of a series of the printing stations 2 and 2' or 112, the layout of the various elements which constitute the rotary press may be designed as desired so as to be commensurate with the building in which it is installed while preventing a useless space from being generated and ensuring that the effective utilization of a limited space can advantageously be achieved. Also, where the second drive source 9, viz. the drive source for a plurality of the printing stations 2 and 2' or 112 is divided into individual drive sources respectively therefor that are mutually independent, the printing stations 2 and 2' or 112 need not necessarily to be disposed as aligned in a row. This will enable the layout of the various elements which constitute a rotary press to be expanded in its degree of freedom.

As set out hereinbefore, a practice of the present invention:

1. Is capable of eliminating an influence of the vibrations that are generated in the folding station(s) onto the printing stations disposed adjacent thereto;

2. Enables the folding stations(s) representing a maximum noise source of the rotary press to he enclosed with a surrounding structure, thus effectively restraining an emission of the noises in the rotary press;

3. Is capable of eliminating a projection that has to be formed in the prior art by a print discharge outlet and a conveyance mechanism associated therewith, as protruding from a row of the printing stations of the folding station(s) in a rotary press;

4. Causes any downstream stage instrument, if disposed in the vicinity of the folding station(s). to be free from influencing on an operation for the prints; If an instrument in a downstream stage is disposed in the vicinity of the folding station, there is no need to transport the prints which are separately dispersed over a long path with a conveyance unit, thus lowering the frequency of occurrence of any inconveniences such as their slippage, crumbling and drops midway of their transportation;

5. Is capable of installing in several divided rows the printing stations which constitute constructional units of a rotary press;

6. Is capable of installing a folding station at any suitable location such as to be commensurate with the building;

7. In adding a printing station to a given rotary press, makes it unnecessary to consider how the folding station is to be installed; and so forth.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A rotary press using a plurality of rolls of paper, comprising:

a plurality of paper feed stations;

a plurality of printing stations that are at least equal in number to said paper feed stations;

a single folding station;

a paper path, in which continuous sheets of paper respectively drawn out of said rolls of paper respectively loaded onto said paper feed stations are guided, as they are overlapped, onto said folding station via said printing stations respectively corresponding to said paper feed stations and are cut in said folding station, and the cut sheets of paper are folded up as prints, the latter being discharged towards an instrument in a downstream stage;

said folding station being physically separated from said printing stations and said paper feed stations and located at a different installation position than an installation position of said printing stations and said paper feed stations;

first drive source means for operating said folding station;

second drive source means provided separately from said first drive source means for operating said printing stations and said paper feed stations; and a control means for controlling both said first drive source means and said second drive source means so that said folding station and said printing stations may, in a constructional unit of the rotary press, be operated in a matched state.

2. A rotary press using a plurality of rolls of paper, as set forth in claim 1, in which said folding station is disposed at a location that is out of a row in which said printing stations are arranged in series as well as from a region which represents an extension thereof.

3. A rotary press using a plurality of rolls of paper, as set forth in claim 1, in which said folding station is disposed adjacent to said instrument in said downstream stage.

4. A rotary press using a plurality of rolls of paper, as set forth in claim 2, in which said folding station is disposed adjacent to said instrument in said downstream stage.

5. A rotary press using a plurality of rolls of paper, as set forth in any one of claims 1, 2, 3 or 4, further comprising a structure for surrounding said folding station, thereby restraining a noise that is emitted therefrom.

6. A rotary press using a rolled sheet of paper, as set forth in claim 3 or claim 4, further comprising a structure for surrounding said folding station as well as said instrument in said downstream stage, thereby restraining noises which are emitted from both of them.

7. A rotary press using a plurality of rolls of paper, comprising:

a plurality of constructional units, each of which includes:

a plurality of paper feed stations, a plurality of printing stations that are at least equal in number to said paper feed stations, a single folding station, and a paper path, in which continuous sheets of paper respectively drawn out of said rolls of paper respectively loaded onto said paper feed stations are guided, as they are overlapped, onto said folding station via said printing station respectively corresponding to said paper feed stations and are cut in said folding station and the cut sheets are folded up as prints, the latter being discharged towards an instrument in a downstream stage;

in each of said constructional units, said folding station being physically separated from said printing stations and said paper feed stations and located at a different installation position than an installation position of said printing stations and said paper feed stations;

first drive source means for operating said folding stations;

second drive source means provided separately from said first drive source means for operating said printing stations and said paper feed stations;

control means capable of selectively combining said printing stations and a respective one of said folding stations together independently of said constructional units for controlling both said first drive source means and said second drive source means so that those said folding stations and said printing stations which are selectively combined together may be operated in a matched state; and a guide mechanism disposed downstream of said printing stations and upstream of said folding stations so as to guide said continuous sheets of paper passed through said printing stations, said mechanism being capable of selectively guiding said continuous sheets of paper onto said folding stations in one and another of said constructional units.

8. A rotary press using a plurality of rolls of paper, as set forth in claim 7, in which, for each of said constructional units, said folding station is disposed at a location that is out of a row in which said printing stations are arranged in series as well as from a region which represents an extension thereof.

9. A rotary press using a plurality of rolls of paper, as set forth in claim 7, in which, for each of said constructional units, said folding station is disposed adjacent to said instrument in said downstream stage.

10. A rotary press using a plurality of rolls of paper, as set forth in claim 8, in which, for each of said constructional units, said folding station is disposed adjacent to said instrument in said downstream station.

11. A rotary press using a plurality of rolls of paper, as set forth in any one of claims 7, 8, 9 or 10, further comprising a structure for surrounding said folding stations, thereby restraining a noise that is emitted therefrom.

12. A rotary press using a plurality of rolls of paper, as set forth in claim 9 or claim 10, further comprising a structure for surrounding said folding stations as well as said instrument in said downstream station, thereby restraining noises which are emitted from both of them.

13. A rotary press using a plurality of rolls of paper, comprising:

a plurality of constructional units, each of which includes:

a plurality of paper feed stations, a plurality of printing stations that are at least equal in number to said paper feed stations, a single folding station, and a paper path, in which continuous sheets of paper respectively drawn out of said rolls of paper respectively loaded onto said paper feed stations are guided, as they are overlapped, onto said folding station via said printing station respectively corresponding to said paper feed stations and are cut in said folding station, and the cut sheets are folded up as prints, the latter being discharged towards an instrument in a downstream stage;

each of said constructional units being independent and separated from each other and arranged in mutually parallel relationship;

in each of said constructional units, said folding station being physically separated from said printing stations and paper feed stations and located at a different installation position than an installation position of said printing stations and paper feed stations;

first drive source means for operating said folding stations;

second drive source means provided separately from said first drive source means for operating said printing stations and said paper feed stations;

control means capable of selectively combining said printing stations and a respective one of said folding stations together independently of said constructional units for controlling both said first drive source means and said second drive source means so that those said folding stations and said printing stations which are selectively combined together may be operated in a matched state; and a guide mechanism disposed downstream of said printing stations and upstream of said folding stations so as to guide said continuous sheets of paper passed through said printing stations, said mechanism being capable of guiding said continuous sheets of paper onto said folding stations selectively in one or another of said constructional units.

14. A rotary press using a plurality of rolls of paper, as set forth in claim 13, in which, for each of said constructional units, said folding station is disposed at a location that is out of a row in which said printing stations are arranged in series as well as from a region which represents an extension thereof.

15. A rotary press using a plurality of rolls of paper, as set forth in claim 13, in which, for each of said constructional units, said folding station is disposed adjacent to said instrument in said downstream stage.

16. A rotary press using a plurality of rolls of paper, as set forth in claim 14, in which, for each of said constructional units, said folding station is disposed adjacent to said instrument in said downstream stage.

17. A rotary press using a plurality of rolls of paper, as set forth in any one of claims 13, 14, 15 or 16, further comprising a structure for surrounding said folding stations, thereby restraining a noise that is emitted therefrom.

18. A rotary press using a plurality of rolls of paper, as set forth in claim 15 or claim 16, further comprising a structure for surrounding said folding stations as well as said instrument in said downstream stage, thereby restraining noises which are emitted from both of them.

19. A printing method using a rotary press with a plurality of rolls of paper, in which there are provided a plurality of paper feed stations, a plurality of printing stations that are at least equal in number to said paper feed stations and a single folding station, and in which continuous sheets of paper respectively drawn out of said rolls of paper respectively loaded onto said paper feed stations are guided, as they are overlapped, onto said folding station via said printing stations respectively corresponding to said paper feed stations and are cut in said folding station, and the cut sheets of paper are folded up as prints, the latter being discharged towards an instrument in a downstream stage, said printing method comprising the steps of:

arranging said folding station at a position physically separated from said printing stations and said paper feed stations and located at a different installation position than an installation position of said printing stations and said paper feed stations;

operating said folding station with first drive source means;

operating said printing stations and said paper feed stations with second drive means which is provided separately from said first drive source means; and controlling said first drive source means and said second drive source means so that said folding station and said printing stations in a constructional unit of the rotary press may be operated in a matched state.

20. A printing method using a rotary press with a plurality of rolls of paper, as set forth in claim 19, further comprising the step of: disposing said folding station at a location that is offset both from a row in which said printing stations are arranged in series and from a region which represents an extension thereof.

21. A printing method using a rotary press with a plurality of rolls of paper, as set forth in claim 19, further comprising the step of: disposing said folding station adjacent to said instrument in said downstream stage.

22. A printing method using a rotary press with a plurality of rolls of paper, as set forth in claim 20, further comprising the step of: disposing said folding station adjacent to said instrument in said downstream stage.

23. A printing method using a rotary press with a plurality of rolls of paper, as set forth in any one of claims 19, 20, 21 or 22, further comprising the step of: surrounding with an enclosure structure said folding station to restrain a noise that is emitted therefrom.

24. A printing method using a rotary press with a plurality of rolls of paper, as set forth in claim 21 or claim 22, further comprising the step of: surrounding with an enclosure structure both said folding station and said instrument in said downstream stage to restrain noises that are emitted from both of them.

25. A printing method using a rotary press with a plurality of rolls of paper, in which there are provided a plurality of constructional units each of which comprises a plurality of paper feed stations, a plurality of printing stations that are at least equal in number to said paper feed stations and a single folding station, and in which continuous sheets of paper respectively drawn out of said rolls of paper respectively loaded onto said paper feed stations are guided, as they are overlapped, onto said folding station via said printing stations respectively corresponding to said paper feed stations and are cut in said folding station, and the cut sheets of paper are folded up as prints, the latter being discharged towards an instrument in a downstream stage, said printing method comprising the steps of:

arranging said folding station in each of said constructional units at a position physically separated from said printing stations and said paper feed stations and located at a different installation position than an installation position of said printing stations and said paper feed stations;

operating said folding stations with first drive source means;

operating said printing stations and said paper feed stations with second drive source means provided separately from said first drive source means;

selectively combining said printing stations and a respective one of said folding stations together independently of said constructional units to control both said first drive source means and said second drive source means so that those said folding station and said printing stations which are selectively combined together may be operated in a matched state; and providing a guide mechanism downstream of said printing stations and upstream of said folding stations to guide said continuous sheets of paper passed through said printing stations, said mechanism being capable of selectively guiding said continuous sheets of paper onto said folding stations in one and another of said constructional units.

26. A printing method using a rotary press with a plurality of rolls of paper, as set forth in claim 25, further comprising the step of: disposing, for each of said constructional units, said folding station at a location that is offset both from a row in which said printing stations are arranged in series and from a region which represents an extension thereof.

27. A printing method using a rotary press with a plurality of rolls of paper, as set forth in claim 25, further comprising the step of: disposing, for each of said constructional units, said folding station adjacent to said instrument in said downstream stage.

28. A printing method using a rotary press with a plurality of rolls of paper, as set forth in claim 26, further comprising the step of: disposing, for each of said constructional units, said folding station adjacent to said instrument in said downstream stage.

29. A printing method using a rotary press with a plurality of rolls of paper, as set forth in any one of claims 25, 26, 27 or 28, further comprising the step of: surrounding with an enclosure structure said folding stations to restrain a noise that is emitted therefrom.

30. A printing method using a rotary press with a plurality of rolls of paper, as set forth in claim 27 or claim 28, further comprising the step of: surrounding with an enclosure both said folding stations and said instrument in said downstream stage to restrain noises that are emitted from both of them.

31. A printing method using a rotary press with a plurality of rolls of paper, in which there are provided a plurality of constructional units, each of which includes a plurality of paper feed stations, a plurality of printing stations that are at least equal in number to said paper feed stations and a single folding station, and in which continuous sheets of paper respectively drawn out of said rolls of paper respectively loaded onto said paper feed stations are guided, as they are overlapped, into said folding station via said printing stations respectively corresponding to said paper feed stations and are cut in said folding stations, and the cut sheets are folded up as prints, the latter being discharged towards an instrument in a downstream station, said printing method comprising the steps of:

arranging said folding station in each of said constructional units at a position physically separated from said printing stations and said paper feed stations and located at a different installation position than an installation position of said printing stations and said paper feed stations;

arranging said constructional units in divided parallel rows, respectively;

operating said folding stations with first drive source means;

operating said printing stations and said paper feed stations with second drive source means provided separately from said first drive source means;

selectively combining said printing stations and a respective one of said folding stations together independently of said constructional units to control both said first drive source means and said second drive source means so that those said folding station and said printing stations which are selectively combined together may be operated in a matched state;

providing a guide mechanism disposed downstream of said printing stations and upstream of said folding stations so as to guide said continuous sheets of paper passed through said printing stations; and selectively guiding, with said guide mechanism, said continuous sheets of paper onto said folding stations in one and another of said constructional units.

32. A printing method using a rotary press with a plurality of rolls of paper, as set forth in claim 31, further comprising the step of: disposing, for each of said constructional units, said folding station at a location that is offset both from a row in which said printing stations are arranged in series and from a region which represents an extension thereof.

33. A printing method using a rotary press with a plurality of rolls of paper, as set forth in claim 31, further comprising the step of: disposing, for each of said constructional units, said folding station adjacent to said instrument in said downstream station.

34. A printing method using a rotary press with a plurality of rolls of paper, as set forth in claim 32, further comprising the step of: disposing, for each of said constructional units, said folding station adjacent to said instrument in said downstream station.

35. A printing method using a rotary press with a plurality of rolls of paper, as set forth in any one of claims 31, 32, 33 or 34, further comprising the step of: surrounding, with an enclosure structure, said folding stations to restrain a noise that is emitted therefrom.

36. A printing method using a rotary press with a plurality of rolls of paper, as set forth in claim 33 or claim 34, further comprising the step of: surrounding, with an enclosure structure, both said folding stations and said instrument in said downstream stage to restrain noises which are emitted from both of them.

* * * * *